US006394917B1

(12) United States Patent
Chiappini et al.

(10) Patent No.: US 6,394,917 B1
(45) Date of Patent: May 28, 2002

(54) GOAL POST WITH ADJUSTABLE COMPONENTS

(75) Inventors: Thomas Aquinas Chiappini, Canton; Brooks Ewing Weingart, Sebring; Kevin Todd Reynolds, Louisville, all of OH (US)

(73) Assignee: P.A.T. Technologies, LLC, Alliance, OH (US)

( * ) Notice: Subject to any disclaimer, the term of this patent is extended or adjusted under 35 U.S.C. 154(b) by 0 days.

(21) Appl. No.: 09/560,066

(22) Filed: Apr. 27, 2000

Related U.S. Application Data

(60) Provisional application No. 60/193,835, filed on Mar. 31, 2000.

(51) Int. Cl.[7] ..... A63B 67/00; A63B 63/00

(52) U.S. Cl. ..... 473/415; 473/439; 473/476; 473/446

(58) Field of Search ..... 273/317, 317.5, 273/400, 407, 343, 354, 127 B, DIG. 8; 473/420, 421, 422, 470–474, 476–478, 439, 438; 40/607; 248/156, 524; 256/70; 52/2.21, 2.13; 33/289; D21/318, 699, 705; D25/66

(56) References Cited

U.S. PATENT DOCUMENTS

| | | | | | |
|---|---|---|---|---|---|
| 2,845,269 | A | | 7/1958 | Simmons | |
| 2,929,630 | A | | 3/1960 | Simmons | |
| 3,675,922 | A | * | 7/1972 | Nieland | 473/420 |
| 3,820,787 | A | * | 6/1974 | Heinbigner | 473/439 |
| 3,831,941 | A | * | 8/1974 | Pease | 473/477 |
| 4,026,554 | A | | 5/1977 | Karkoska | |
| 5,429,350 | A | * | 7/1995 | Meier | 473/477 |
| 5,681,231 | A | * | 10/1997 | Reeves | 473/471 |
| 5,816,954 | A | * | 10/1998 | Zheng | 473/471 |
| 5,857,928 | A | * | 1/1999 | Stewart | 473/446 |
| 6,024,659 | A | * | 2/2000 | Reed | 473/477 |

FOREIGN PATENT DOCUMENTS

| | | | | |
|---|---|---|---|---|
| FR | 2713943 | * | 12/1993 | 473/477 |

OTHER PUBLICATIONS

Football Rules Illustrated; p. 4 (goal posts); 1981.*

* cited by examiner

*Primary Examiner*—Paul T. Sewell
*Assistant Examiner*—Mitra Aryanpour
(74) *Attorney, Agent, or Firm*—Sand & Sebolt

(57) ABSTRACT

The football goal post of the present invention includes a cross bar that allows the spacing of the uprights to be selectively adjusted by the user of the goal post. A variety of embodiments are disclosed showing different arrangements for adjusting the spacing of the uprights. In some of the embodiments, the uprights are simultaneously adjusted by a single actuator. In other embodiments, the uprights may be manually adjusted while in other embodiments the uprights may be adjusted from a remote location. The invention also provides an adjustable ground sleeve that allows the goal post to be raised and lowered and rotated about the x, y, and z axes so that it may be precisely aligned with the football field during and after installation.

26 Claims, 38 Drawing Sheets

| Fig. 3A | Fig. 3B | Fig. 3C |
|---|---|---|
Fig. 3
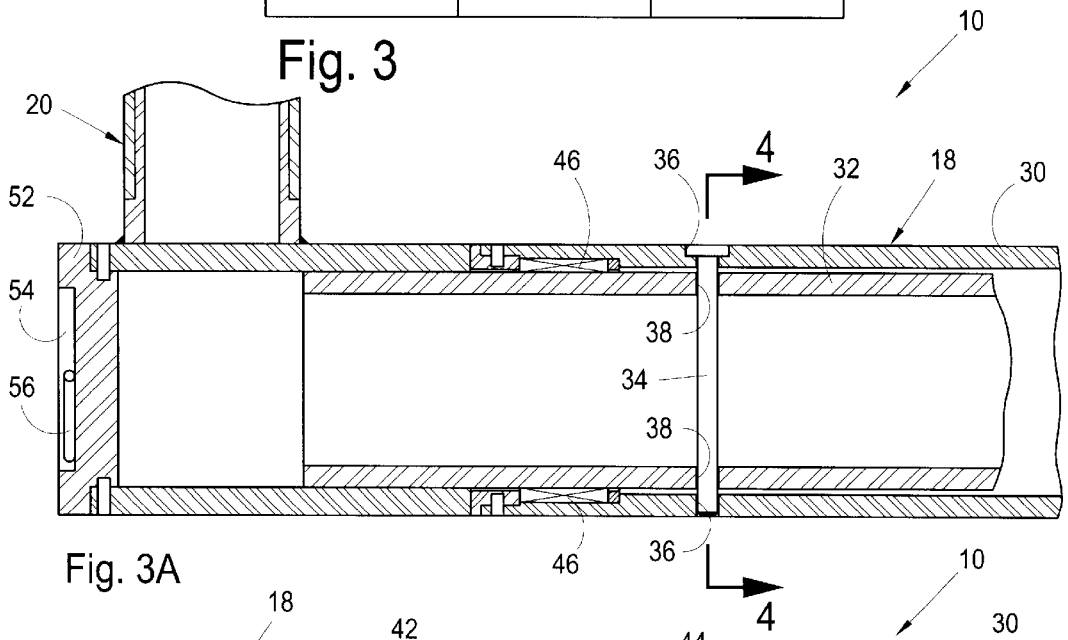
Fig. 3A
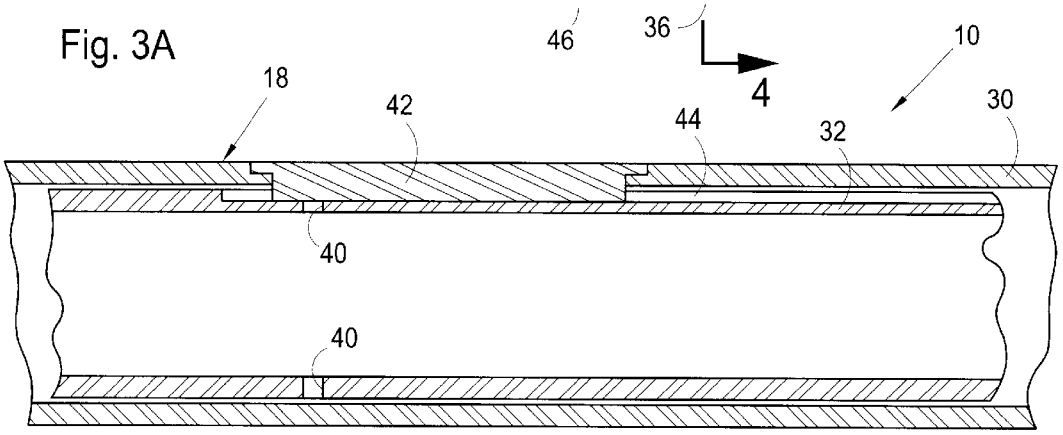
Fig. 3B
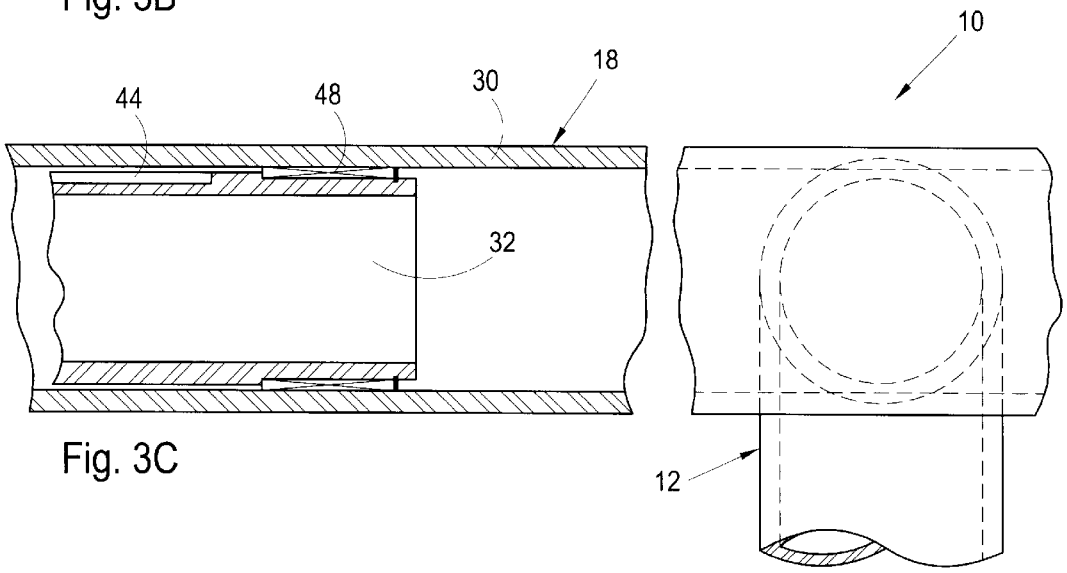
Fig. 3C

| Fig. 5A | Fig. 5B |
|---|---|

| Fig. 7A | Fig. 7B | Fig. 7C |
|---|---|---|

| Fig. 9A | Fig. 9B | Fig. 9C |
|---|---|---|
Fig. 9
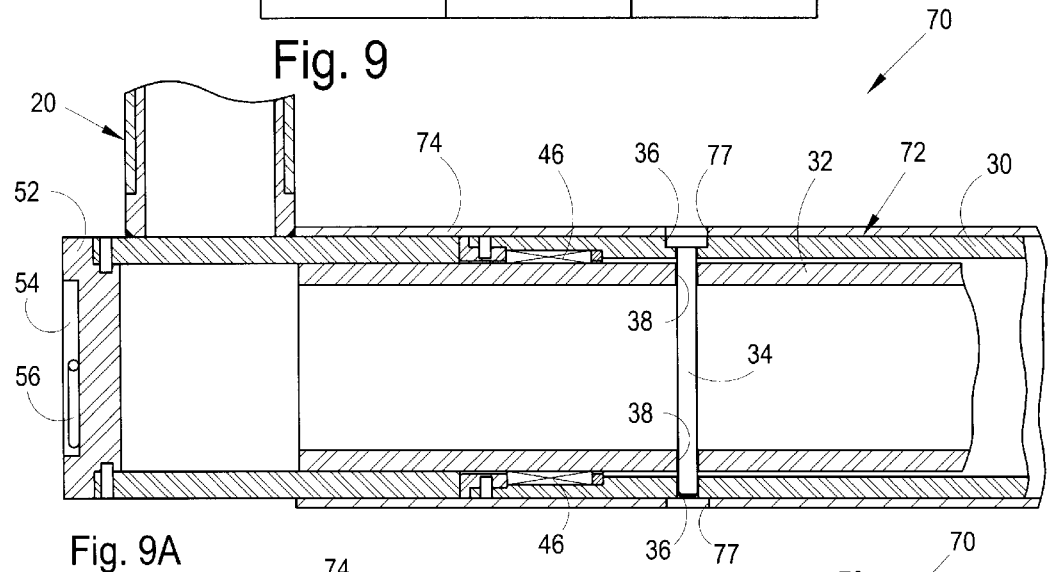
Fig. 9A
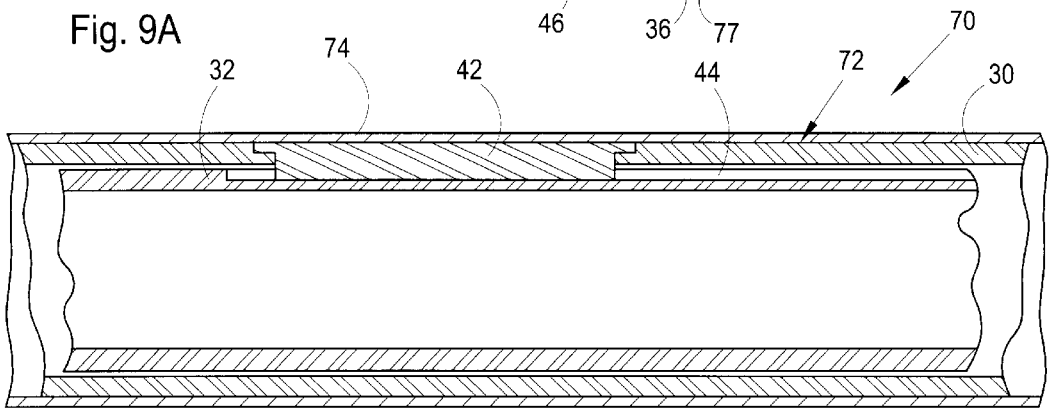
Fig. 9B
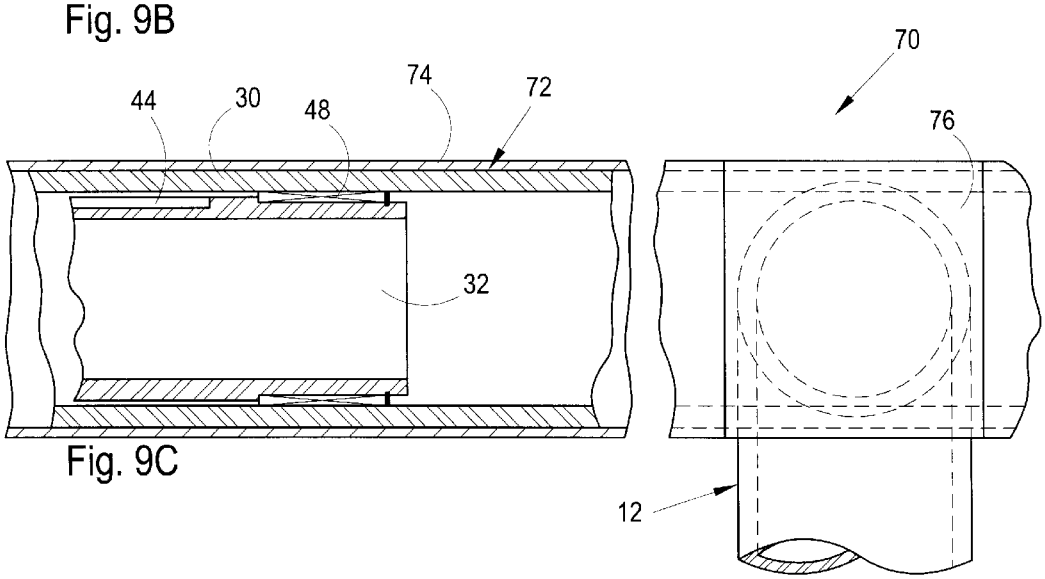
Fig. 9C

| Fig. 10A | Fig. 10B |
|---|---|

| Fig. 11A | Fig. 11B | Fig. 11C |
|---|---|---|
Fig. 11
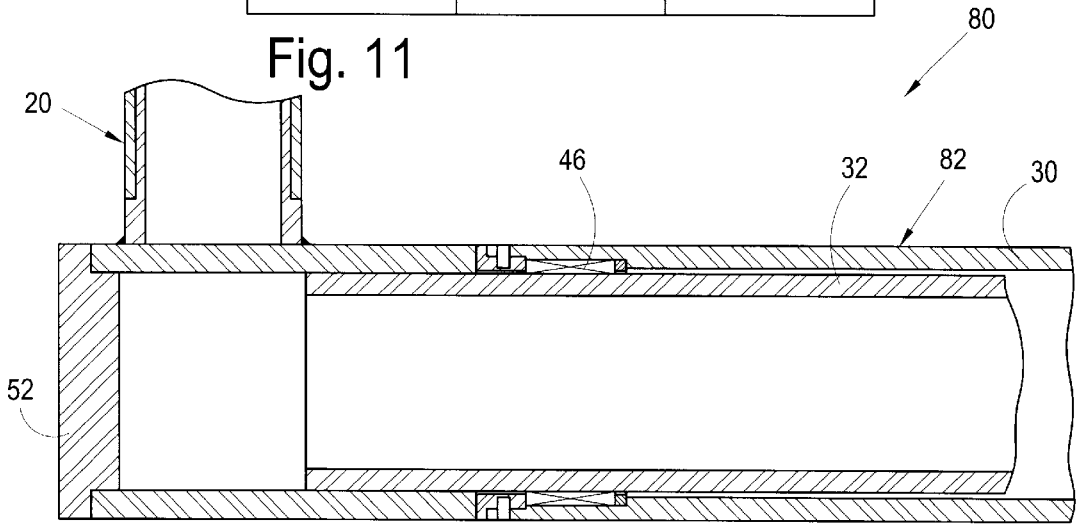
Fig. 11A
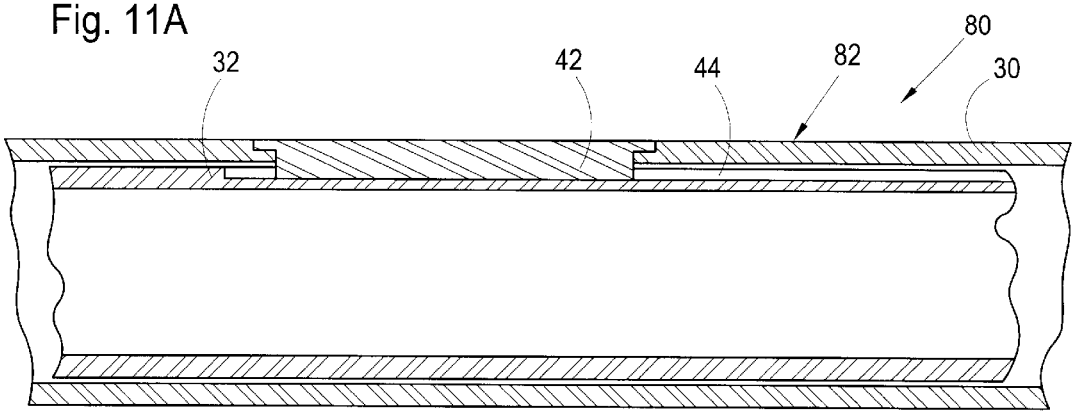
Fig. 11B
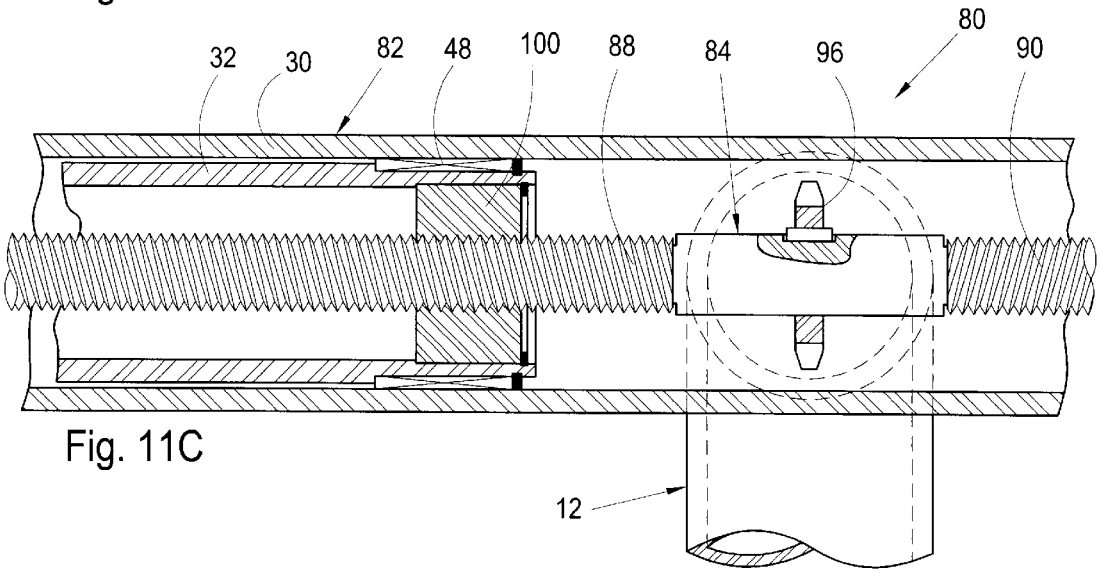
Fig. 11C

| Fig. 12A | Fig. 12B |
|---|---|

| Fig. 14A | Fig. 14B | Fig. 14C |
|---|---|---|

| Fig. 17A | Fig. 17B | Fig. 17C |
|---|---|---|

| Fig. 20A | Fig. 20B | Fig. 20C |
|---|---|---|

| Fig. 21A | Fig. 21B | Fig. 21C |
|---|---|---|

GOAL POST WITH ADJUSTABLE COMPONENTS

CROSS REFERENCE TO RELATED APPLICATIONS

This application claims priority from application Ser. No. 60/193,835 filed Mar. 31, 2000, the disclosures of which are incorporated herein by reference.

BACKGROUND OF THE INVENTION

1. Technical Field

The present invention generally relates to sporting goal structures and, more particularly, to a football goal post having adjustable components. Specifically, the present invention provides a football goal post having adjustable-width uprights and a ground sleeve that allows the overall position of the goal post to be adjusted about three axes.

2. Background Information

A football goal post is used for field goals and extra points in a typical football game. A football goal post includes a generally U-shaped goal area supported by a goose neck extending up from the ground. The U-shaped goal area is defined by a cross bar extending horizontally from the goose neck and a pair of uprights extending generally vertically from either end of the cross bar. The dimensions of a football goal post are specifically defined by the rules of the particular football league for which the goal post will be used. The rules define the height of the cross bar, the width of the uprights, the height of the uprights, and the placement of the goal post with respect to the field.

Football is played on many different levels in the United States. Although the basic tenants of the game are consistent throughout each level, pee-wee leagues have different rules than professional leagues for obvious reasons. On the high school, college, and professional level, one rule difference is that high school goal posts have wider uprights than pro and college uprights. This rule prevents a high school game from being played immediately before or after a college game on the same field. If two such games are scheduled, field management must schedule enough time between games for the maintenance staff to change the goal posts. In some situations, the staff must change the entire goal post. In other situations, the staff must remove the cross bar and uprights, change the cross bar, and reinstall the cross bar and uprights. In either situation, the goal post must be carefully repositioned so that the cross bar is horizontal, the exact height above the field, square to the field, and with the uprights substantially vertical. In the past, goal posts have not included adjustment mechanisms that allow the user to easily adjust the elements of the goal post. Current goal post changeovers require a group of workers and a cherry picker to hold the cross bar.

Numerous athletic facilities throughout the country are used by both high school and college teams. The efficiency of these facilities could be increased by providing a football goal post that enables a quick changeover between the high school and college positions. A football goal post that is readily adjustable with respect to the ground could also increase the efficiency of these facilities. Increased efficiency would lead to greater revenue for the athletic facility through increased use of the field. For instance, instead of a single college afternoon game and a single high school night game requiring a significant time span in between the games to change over the goal posts, the athletic facility could schedule the afternoon college game followed by a pair of high school games due to the savings in time for changing over the goal post. Another benefit to the invention is the savings in manpower and equipment for changing over the goal post.

SUMMARY OF THE INVENTION

In view of the foregoing, an objective of the present invention is to provide a goal post having adjustable components.

Another objective of the present invention is to provide a goal post having adjustable components that allow the width of the uprights to be selectively changed.

Another objective of the present invention is to provide a goal post having adjustable components that allow the position of the goose neck to be adjusted about three axes while the goose neck is mounted to the ground.

Another objective of the present invention is to provide a goal post having adjustable components wherein the adjustments may be made by a single worker.

Another objective of the present invention is to provide a goal post having adjustable components wherein the vertical uprights may be moved from a pro. college position to a high school position simply by pulling the uprights outwardly.

Another objective of the present invention is to provide a goal post having adjustable components wherein the uprights may be moved from the high school position to the pro college position and vice versa by turning a single actuator.

Another objective of the present invention is to provide a goal post having adjustable components that allows the spacing of the uprights to be adjusted by rotating a threaded component associated with each of the uprights.

Another objective of the present invention is to provide a goal post having adjustable components wherein the spacing between the uprights may be adjusted using linear actuators.

Another objective of the present invention is to provide a goal post having adjustable components wherein the spacing between the uprights may be adjusted using a rack and pinion system.

Another objective of the present invention is to provide a goal post having adjustable components wherein the spacing between the uprights may be adjusted pneumatically or hydraulically.

Another objective of the present invention is to provide a goal post having adjustable components that includes a pair of thickness compensation sleeves that maintain the constant diameter of the cross bar when the spacing between the uprights is pulled apart in the high school configuration.

Another objective of the present invention is to provide a goal post having adjustable components wherein a thin sleeve moves with each of the uprights to maintain a substantially constant diameter along the cross bar when the uprights are moved between the high school and pro/college position.

Another objective of the present invention is to provide a goal post having adjustable components wherein a ground sleeve supports the goose neck of the goal post in a fully adjustably manner.

Another objective of the present invention is to provide a football goal post having an adjustable ground sleeve wherein the ground sleeve allows the height of the cross bar to be adjusted, the angle of the goose neck with respect to vertical to be adjusted, and the angle of the cross bar with respect to the field to be adjusted.

These and other objectives are achieved by a football goal post, the general nature of which may be stated as including a base; a cross bar having first and second opposite ends; the cross bar including a first member connected to the base and a pair of second members movable relative to the first member; a first upright carried by the cross bar and extending up from the first end of the cross bar; a second upright carried by the cross bar and extending up from the second end of the cross bar; and adjustment means for simultaneously adjusting the relative position of the first and second members of the cross bar to adjust the spacing of the uprights.

Other objectives and advantages of the invention are achieved by a football goal post, including a base; a cross bar having first and second opposite ends; the cross bar including a first member connected to the base and a pair of second members movable relative to the first member; a first upright carried by the cross bar and extending up from the first end of the cross bar; a second upright carried by the cross bar and extending up from the second end of the cross bar; adjustment means for allowing the relative position of the first and second members of the cross bar to be adjusted to adjust the spacing of the uprights; and sleeve means for maintaining a substantially constant diameter along the cross bar.

Further objectives and advantages of the invention include football goal post, including a base; a cross bar having first and second opposite ends; the cross bar including a first member connected to the base and a pair of second members movable relative to the first member; a first upright carried by the cross bar and extending up from the first end of the cross bar; a second upright carried by the cross bar and extending up from the second end of the cross bar; a first adjustment mechanism disposed between the first member and one of the second members; a second adjustment mechanism disposed between the first member and the other of the second members; and each of the adjustment mechanisms capable of adjusting the relative position of a second member with respect to the first member.

Other objectives and advantages of the invention are achieved by a football goal post, including a base; a cross bar having first and second opposite ends; the cross bar including a first member connected to the base and a pair of second members movable relative to the first member; each of the second members selectively slidable with respect to the first member between retracted and extended positions, the first and second uprights being closer to each other when the uprights are in the retracted position than when the second members are in the extended position; each of the second members being at least partially disposed within the first member; a first upright carried by one of the second members and extending up from the first end of the cross bar; a second upright carried by the other of the second members and extending up from the second end of the cross bar; and each of the second members being manually movable with respect to the first member.

Still other objectives and advantages of the invention are achieved by a football goal post mounted in the ground; the goal post including an adjustable ground sleeve adapted to be mounted to the ground; a base being mounted in the adjustable ground sleeve; a cross bar having first and second opposite ends; a first upright carried by the cross bar and extending up from the first end of the cross bar; a second upright carried by the cross bar and extending up from the second end of the cross bar; and the adjustable ground sleeve configured to allow the base to be adjusted about three perpendicular axes as well as being raised or lowered along one of the three perpendicular axes.

BRIEF DESCRIPTION OF THE DRAWINGS

The preferred embodiments of the invention, illustrative of the best mode in which applicant contemplated applying the principles of the invention, are set forth in the following description and are shown in the drawings and are particularly and distinctly pointed out and set forth in the appended Claims.

FIG. 3 is a view including of FIGS. 3A, 3B, and 3C;

FIG. 3A is a sectional view of the end of the first embodiment of the adjustable goal post;

FIG. 3B is a sectional view of an intermediate portion of the first embodiment of the adjustable goal post;

FIG. 3C is a view, partially in section, of the middle portion of the first embodiment of the adjustable cross bar component;

FIG. 9 includes FIGS. 9A, 9B, and 9C;

FIG. 9A is a sectional view of one end of a third embodiment of the adjustable cross bar component;

FIG. 9B is a sectional view of an intermediate portion of the third embodiment of the adjustable cross bar component;

FIG. 9C is a view, partially in section, of the middle portion of the third embodiment of the adjustable cross bar component;

FIG. 11 includes FIGS. 11A, 11B, and 11C;

FIG. 11A is a sectional view of the end portion of the fourth embodiment of the adjustable cross bar component;

FIG. 11B is a sectional view of an intermediate portion of the fourth embodiment of the adjustable cross bar component;

FIG. 11C is a sectional view of the middle portion of the fourth embodiment of the adjustable cross bar component;

FIG. 2B is a sectional view of an intermediate portion of the seventh embodiment of the adjustable cross bar component;

Similar numbers refer to similar parts throughout the specification.

DESCRIPTION OF THE PREFERRED EMBODIMENTS

Figure 1:
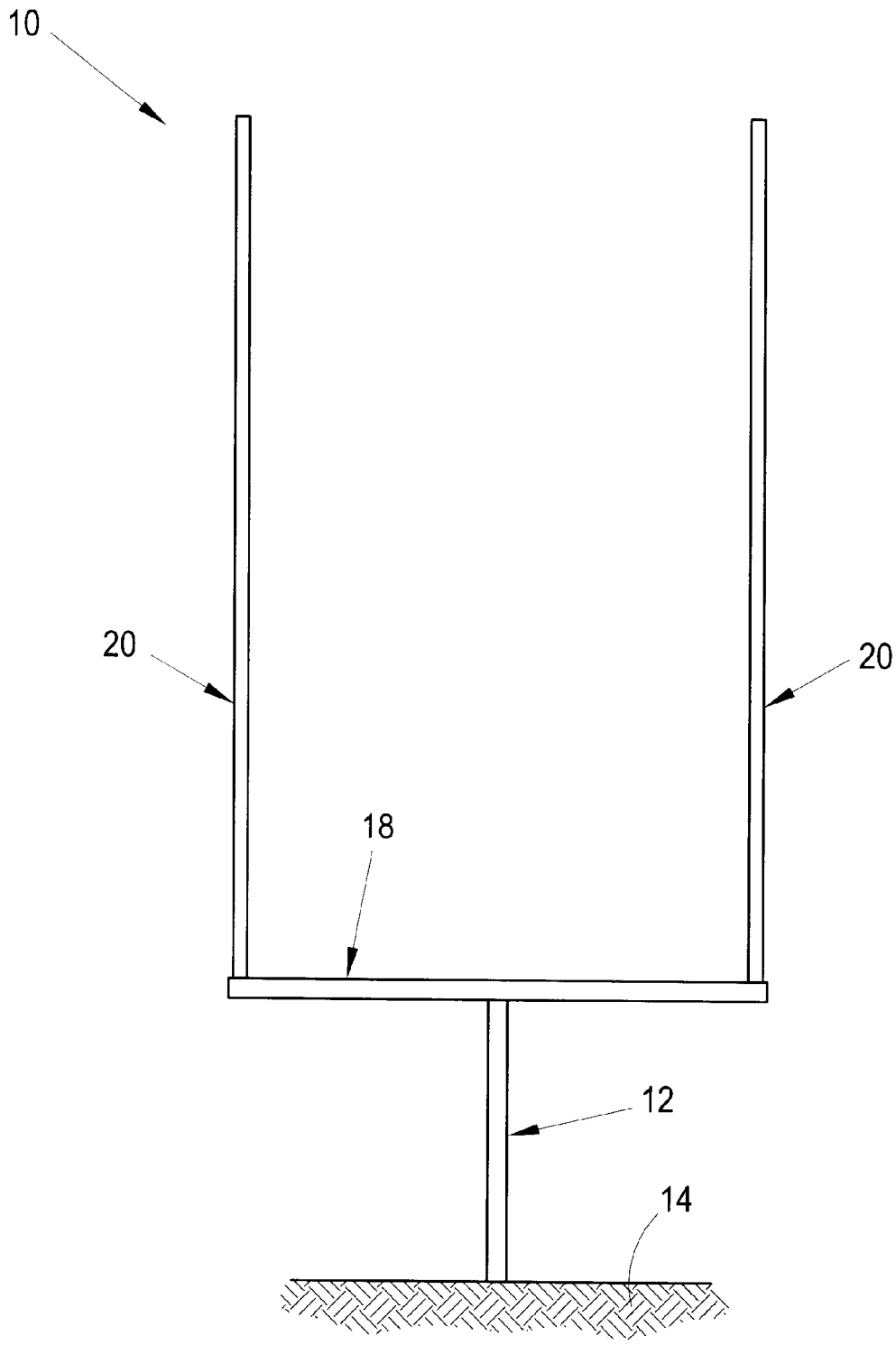
FIG. 1 is a front elevational view showing a football goal post configured for the pro/college rules.

The first embodiment of the adjustable goal post of the present invention is indicated generally by the numeral 10 in FIGS. 1–6. In accordance with the objectives of the present invention, goal post 10 may be selectively configured to be used with the pro and college games as well as high school games. Goal post 10 includes a base that is preferably in the form of a goose neck 12 that is held in the ground 14 by a ground sleeve 16 (FIGS. 26–33). Although goose neck 12 is preferred, the base of goal post 10 may be provided in a variety of other known forms such as a pair of supports or a single straight support. A cross bar 18 is carried by goose neck 12. Cross bar 18 is selectively adjustable so that it may be used with both high school and college/pro rules. A pair of uprights 20 are carried by the outer ends of cross bar 18 and extend upwardly to define the goal area where the football player kicks the football to score extra points and field goals.

Figure 2:
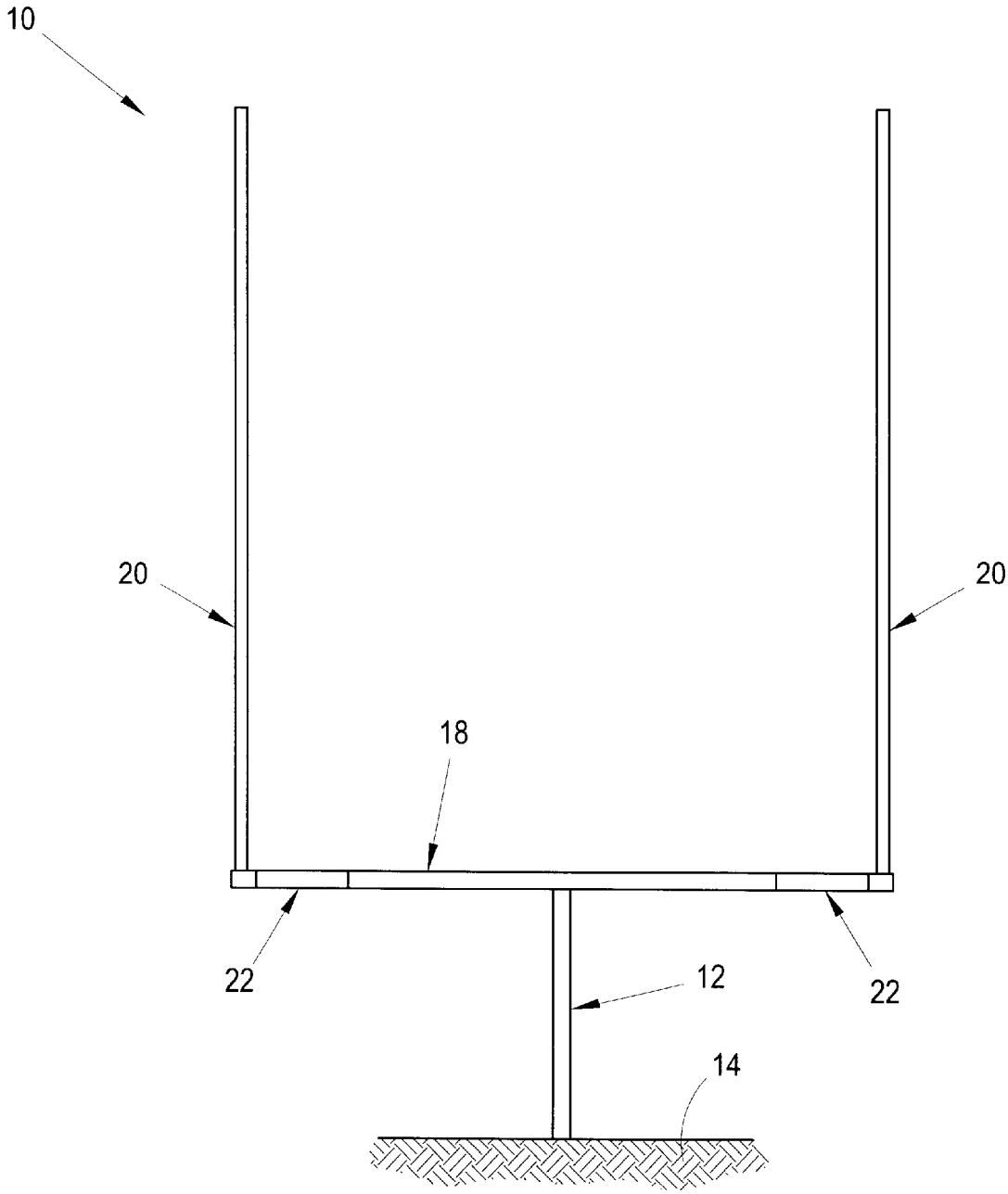
FIG. 2 is a view similar to FIG. 1 showing the goal post configured for the high school rules.
Figure 4:
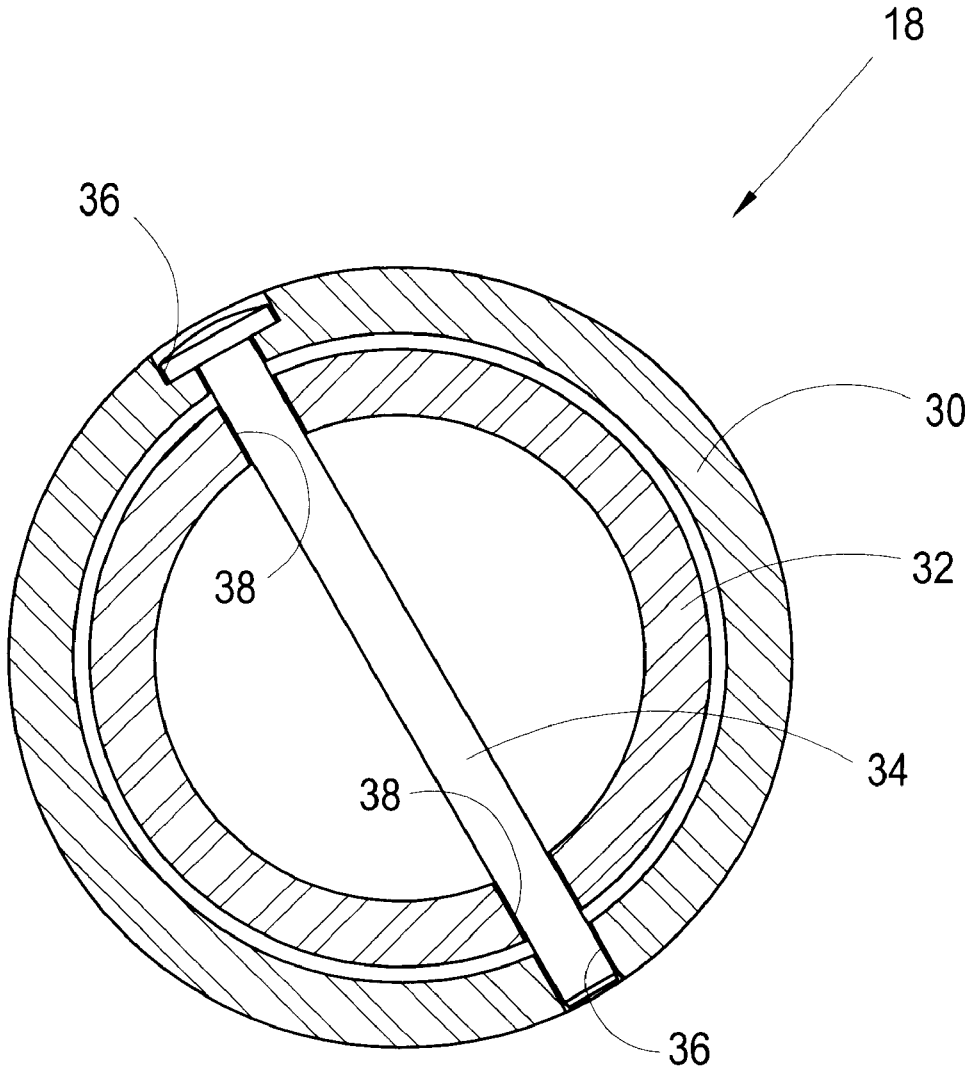
FIG. 4 is a sectional view taken along line 4—4 of FIG. 3A.

Goal post 10 is constructed to allow the user to configure uprights 20 in a pro/college position as shown in FIG. 1 or a high school position as shown in FIG. 2. In the following specification, the pro/college position may also be referred to as the retracted position with the high school position being referred to as the extended position. Cross bar 18 is selectively extendable and retractable allowing goal post 10 to be configured for the different rules. The adjustability of goal post 10 allows a single athletic field to be used for consecutive high school and college games without requiring a crew of workers to tear down one set of uprights and reinstall another set. Goal post 10 thus increases the efficiency of an athletic facility by allowing more games to be played and reducing the overall cost of changing over the goal post.

In accordance with another objective of the present invention, cross bar 18 is configured to maintain a substantially constant diameter throughout its length when positioned in the extended position. In the first embodiment of adjustable cross bar component 18, a pair of sleeves 22 (FIG.

Figures 5, 5A:
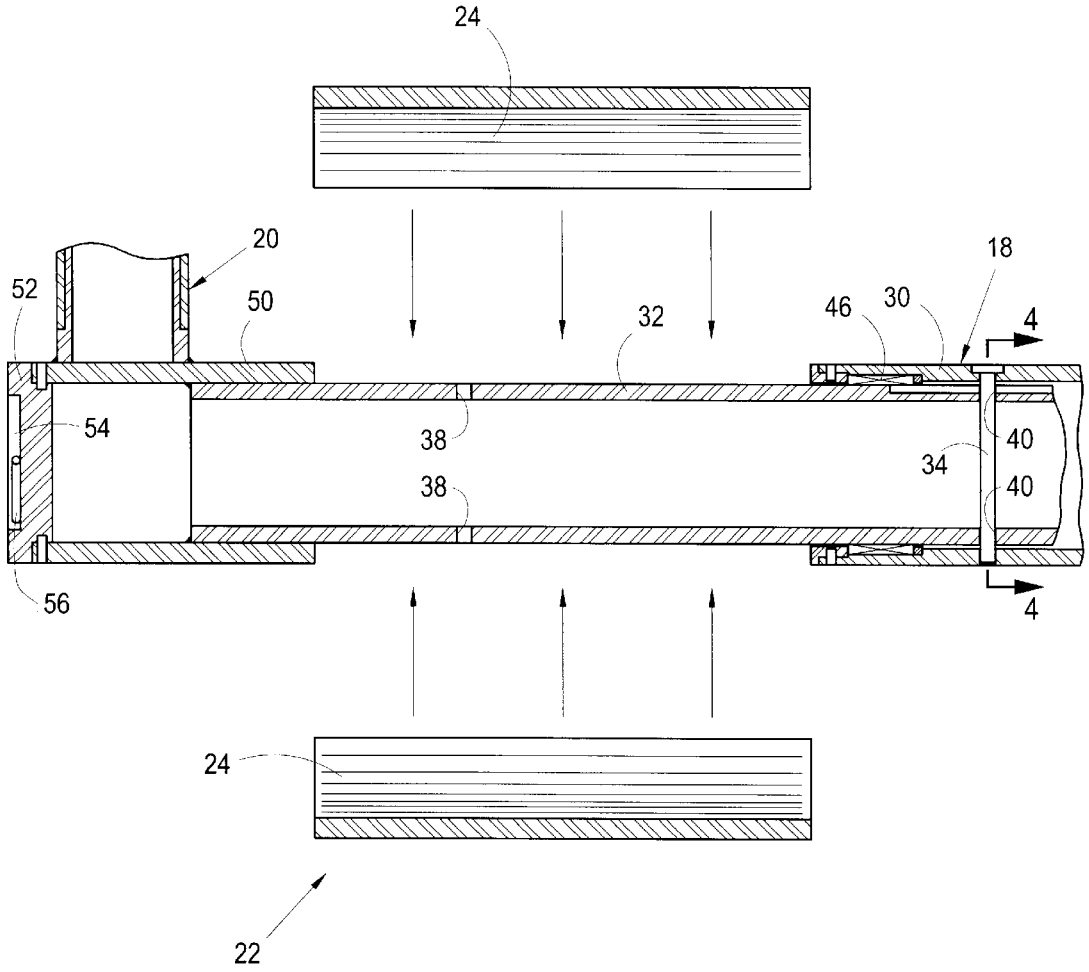
FIG. 5 is a view including FIGS. 5A and 5B.
FIG. 5A an exploded view of the first embodiment of the adjustable cross bar component in an extended condition showing the sleeves being installed onto the cross bar.
Figure 5B:
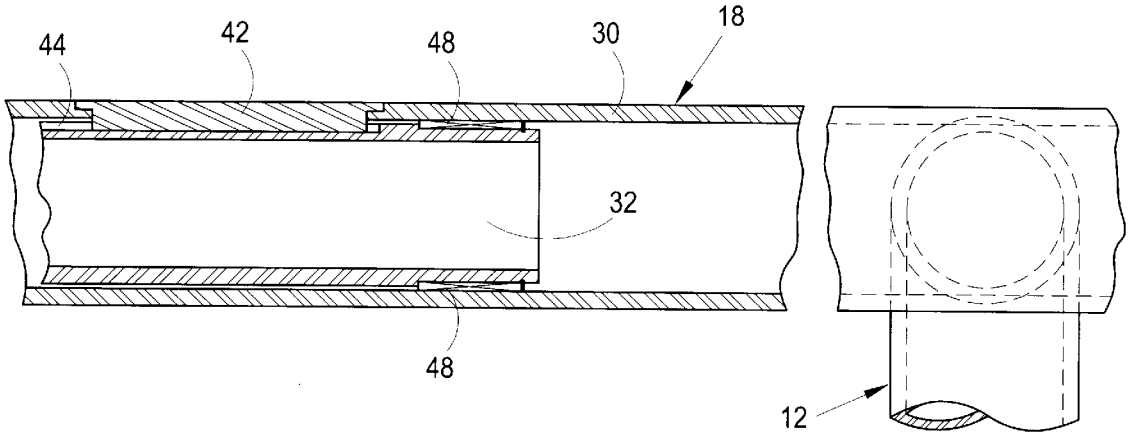
FIG. 5B is a view, partially in section, of the adjustable cross bar component in the extended position.
Figure 6:
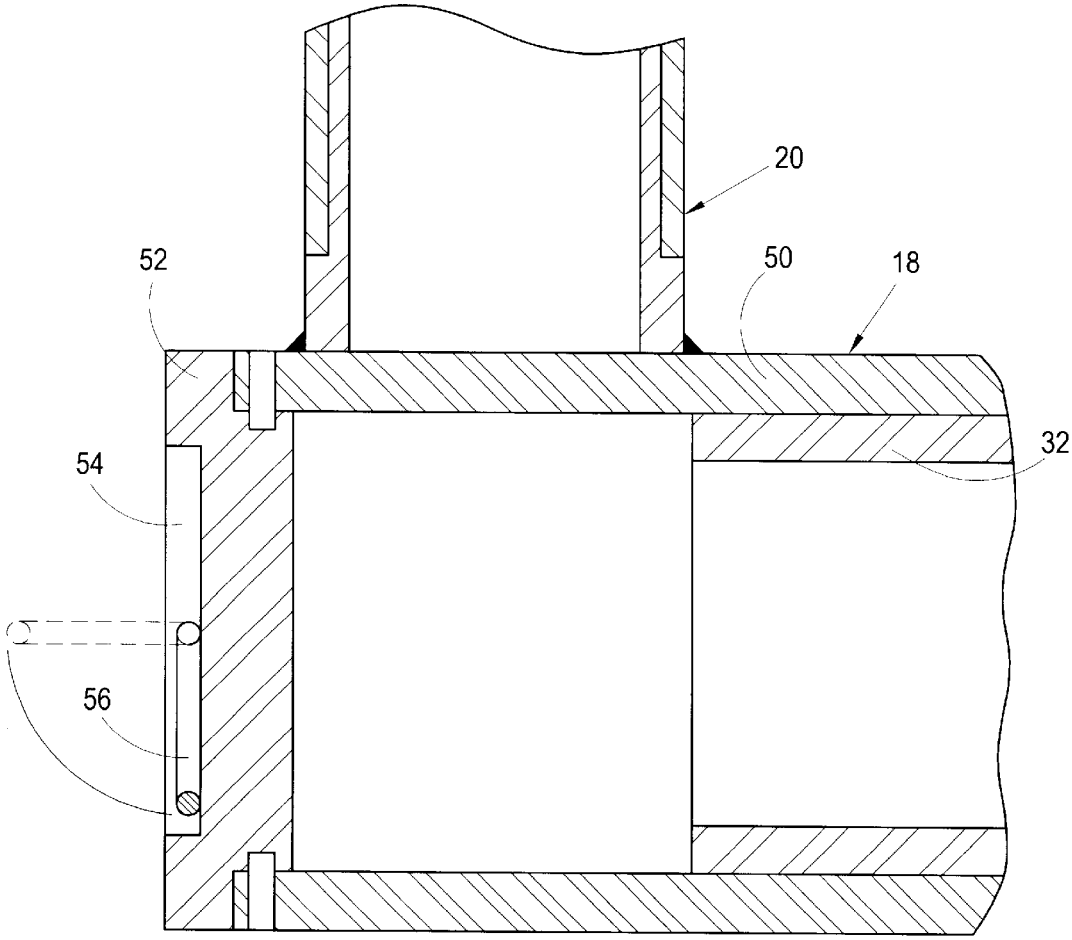
FIG. 6 is an enlarged view of the end of the first embodiment of the adjustable cross bar component showing the handle that assists the user in pulling the uprights outwardly.

2 and FIG. 5A) having the same outer diameter as the remainder of cross bar 18 are positioned in the gaps created when cross bar 18 is extended to maintain the constant outer diameter. Sleeves 22 are important because the football rules require cross bar 18 to have a substantially constant outer diameter. Each sleeve 22 includes a pair of sleeve halves 24 positioned on either side of cross bar 18 to form sleeve 22. In the preferred embodiment, sleeve halves 24 are semi-cylindrical and are retained on cross bar 18 by appropriate connectors such as screws or bolts. In other embodiments, halves 24 may be held on cross bar 18 by providing halves with extensions that slip into openings in crossbar 18 to form an interference fit preventing halves 24 from falling off cross bar 18.

The first embodiment of goal post 10 generally includes a first member 30 and a second member 32. Second member 32 is carried by first member 30 in a manner that allows second member 32 to be slidably adjusted between a retracted and an extended position as shown in FIGS. 3 and 5. In the preferred embodiment, members 30 and 32 each have a circular cross section. In the first embodiment, second member 32 is moved from the retracted position depicted in FIG. 3 to the extended position depicted in FIG. 5 by removing a locking pin 34 and sliding second member 32 outwardly away from first member 30. First member 30 may be connected to goose neck 12 by permanent connection such as a weld. Member 30 may also be removably connected to goose neck 12 by connectors that allow cross bar 18 to be easily removed such as a bolted sleeve or a threaded connector.

First member 30 includes a pair of locking holes 36 which receive locking pin 34. One locking hole 36 is preferably counterbored so that the head of locking pin 34 may be received in the counterbore so that the head is flush with or countersunk under the outer surface of first member 30. Second member 32 includes a pair of first locking holes 38 that are adapted to receive locking pin 34. First locking holes 38 are positioned to be aligned with locking holes 36 when second member 32 is in the retracted position as shown in FIG. 3. Second member 32 also includes a set of second locking holes 40 disposed at a position to align with locking holes 36 when second member 32 is in the extended position as shown in FIG. 5.

Although locking pin 34 helps to retain the relative rotational position of first member 30 with respect to second member 32, a key 42 is also required to maintain the rotational positions of first and second members 30 and 32 while locking pin 34 is removed and second member 32 is being adjusted. Key 42 is connected to first member 30 by appropriate means such as screws, bolts, an interference fit, or the like. Although the specific manner of connecting key 42 to first member 30 may vary, the outer surface of key 42 is preferably substantially flush with the outer surface of first member 30 so that cross bar 18 has a continuous outer surface. Key 42 is preferably removable from first member 30 to facilitate assembly and disassembly of goal post 10.

Key 42 is received in a keyway 44 formed in the outer surface of second member 32. Keyway 44 may be formed so that key 42 engages the end of keyway 44 when locking holes 36 are aligned with first locking holes 38 and second locking holes 40 so that the placement of locking pin 34 may be easily achieved. In the embodiment depicted in the drawings, keyway 44 is longer requiring the user to manually align locking holes 36 with locking holes 38 and 40.

Second member 32 is slidably supported with respect to first member 30 by first 46 and second 48 bearings. Each bearing 46 and 48 is preferably seated in a shouldered area of first member 30 and second member 32 to prevent bearings 46 and 48 from moving during adjustment of cross bar 18. Each bearing 46 and 48 may be further anchored in place with a suitable anchoring device such as a screw, a bolt, a pin, a clip, a key, or the like. In the embodiment of the invention depicted in the drawings, bearing 46 is seated against a shoulder formed in the end of member 30 while bearing 48 is seated against a shoulder formed in the end of member 32.

Uprights 20 are supported on the outer ends of second members 32. Upright 20 may be connected to a sleeve 50 that is, in turn, connected to the outer end of second member 32. Sleeve 50 has the same outer diameter as first member 30 so that a constant diameter is maintained along cross bar 18. An end plate 52 is mounted on the outer end of sleeve 50. End plate 52 may preferably include a recess 54 and a handle disposed within recess 54. In other embodiments, end plate 54 is solid as shown in FIG. 11A. Handle 56 may also be used with the solid embodiment of end plate 52. Handle 56 allows the user of goal post 10 to easily pull second member 32 away from first member 30 when the user is adjusting goal post 10. Handle 56 is preferably pivotally connected to end plate 52 so that it may be disposed within recess 54 when not in use.

First embodiment of goal post 10 is adjusted by removing locking pin 34, pulling second member 32 outwardly using handle 56 until second locking holes 40 align with locking holes 36, and replacing locking pin 34. Cross bar 18 is now in the extended position as shown in FIG. 5. Sleeve halves 24 are then positioned over second member 32 so that cross bar 18 has a constant diameter while in use. To move back to the retracted position, the user removes sleeves 24, removes pin 34, pushes second member 32 back into first member 30, and replaces locking pin 34 in locking holes 36 and 38.

Figure 7:
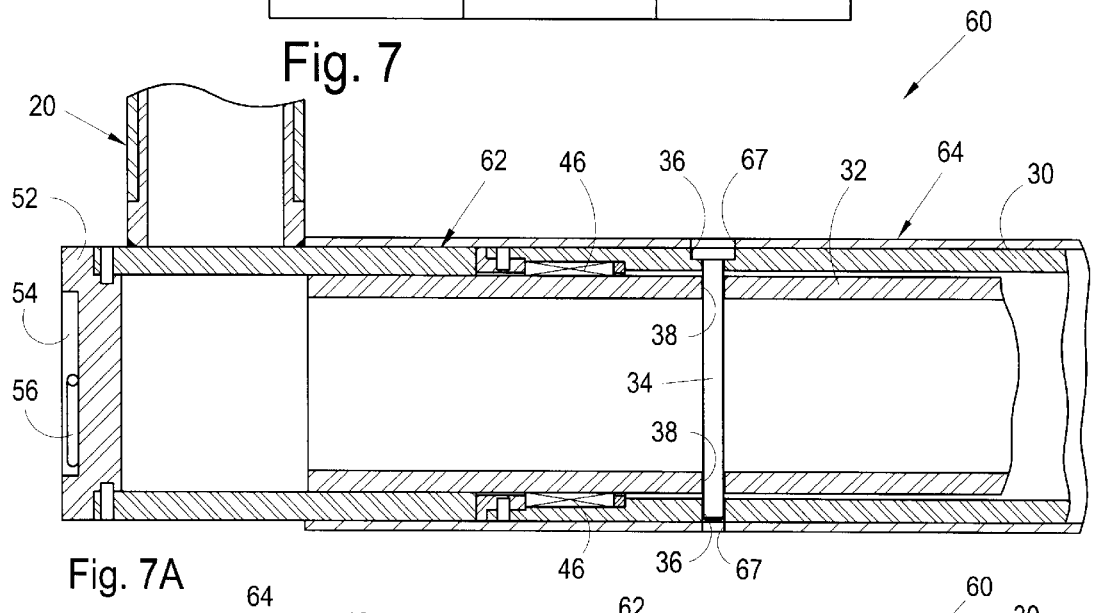
FIG. 7 includes FIG. 7A, 7B, and 7C.
Figure 7A:
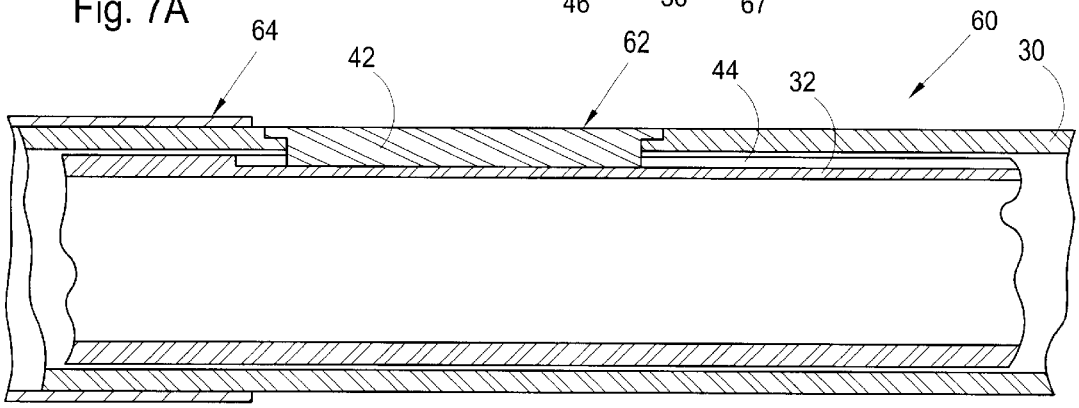
FIG. 7A is a sectional view of the end of a second embodiment of the adjustable cross bar component disposed in the pro/college position.
Figure 7B:
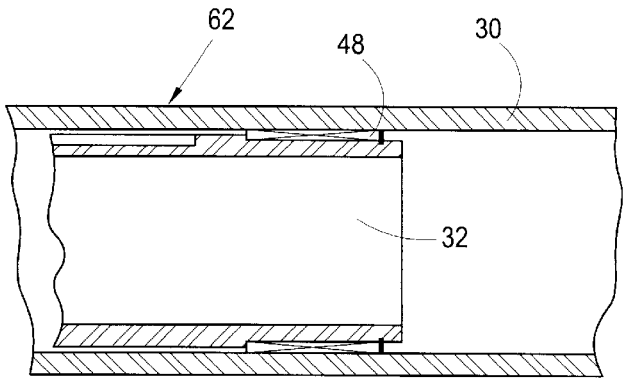
FIG. 7B is a sectional view of an intermediate portion of the second embodiment of the adjustable cross bar component.
Figure 7C:
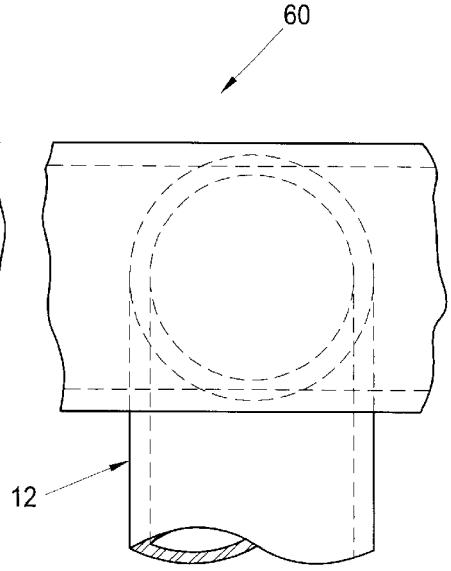
FIG. 7C is a view, partially in section, of the middle portion of the second embodiment of the adjustable cross bar component.
Figure 8:
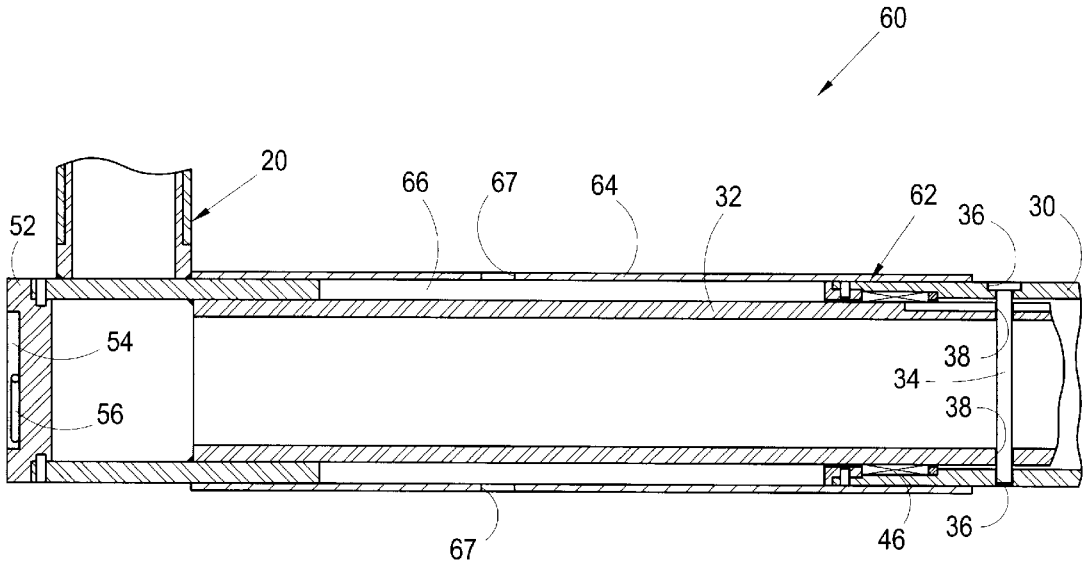
FIG. 8 is a sectional view of approximately half of the second embodiment of the adjustable cross bar component showing the component in an extended position.

The second embodiment of the goal post of the present invention is indicated generally by the numeral 60 in FIGS. 7 and 8. Goal post 60 includes many of the same elements as goal post 10 and these elements are identified with the same numbers as goal post 10. Goal post 60 includes a cross bar 62 that automatically maintains a substantially constant diameter along its length throughout the adjusted positions. This is accomplished by providing a thin sleeve 64 connected to second member 32 so that it moves with second member 32. Sleeve 64 thus covers the space 66 (FIG. 8) that is created when second member 32 is pulled outwardly to the extended position. Sleeve 64 is thin enough to give cross bar 62 a substantially constant diameter along its length. As shown in FIG. 7, sleeve 64 includes at least one hole 67 that allows access to pin 34. Sleeve 64 may also include a pair of holes 67.

Figures 10, 10A:
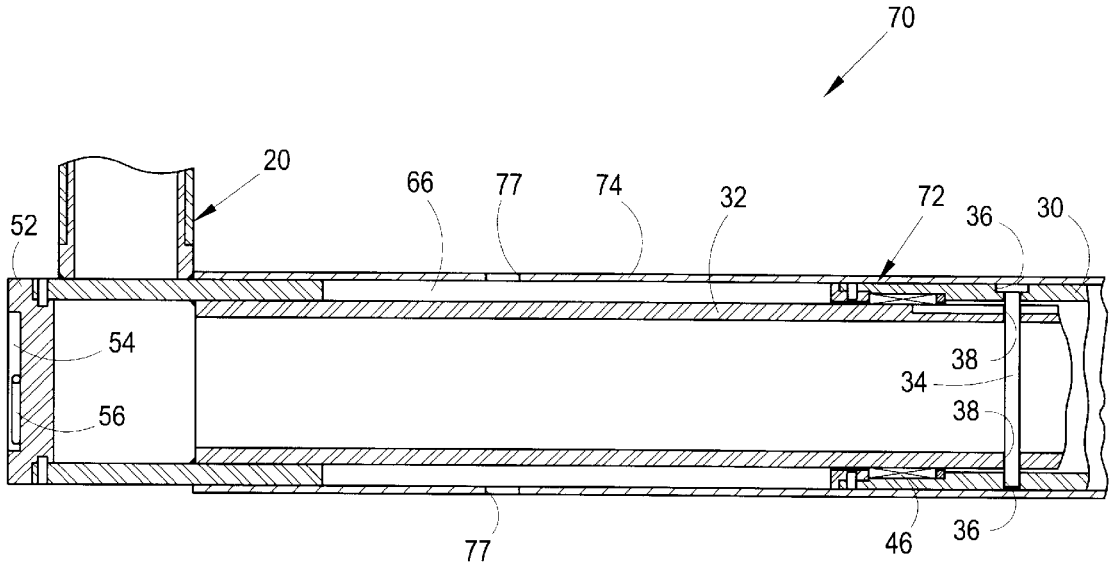
FIG. 10 includes FIGS. 10A and 10B.
FIG. 10A is a sectional view of approximately half the third embodiment of the adjustable cross bar component in an extended position.
Figure 10B:
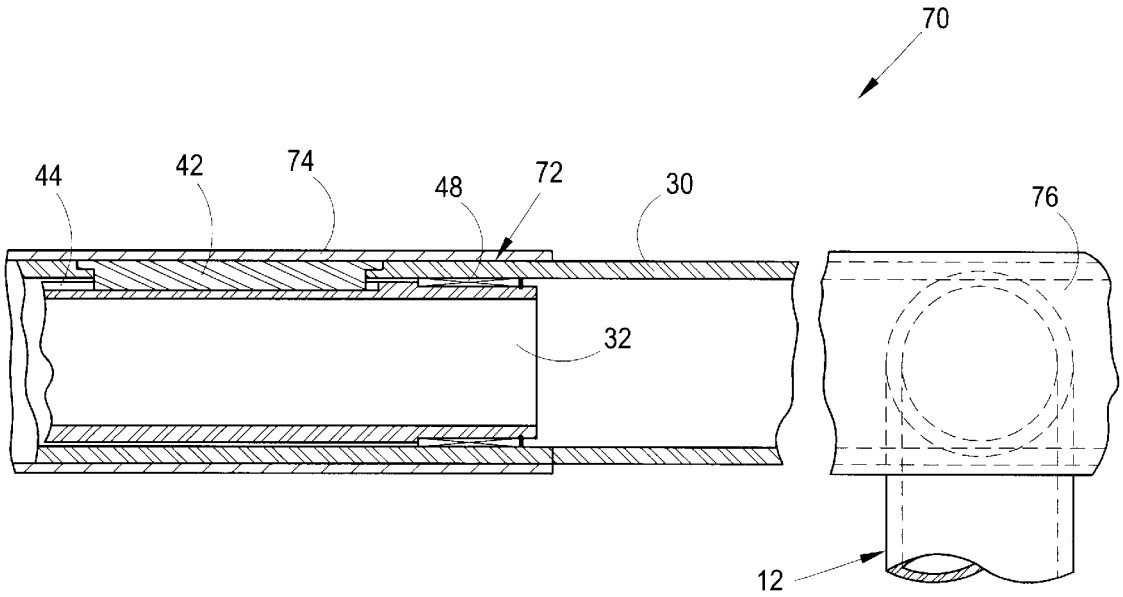
FIG. 10B is a view, partially in section, of the middle portion of the third embodiment of the adjustable cross bar component in the extended position.

The third embodiment of the goal post of the present invention is indicated generally by the numeral 70 in FIGS. 9 and 10. Goal post 70 is similar to goal post 60 because it maintains a substantially constant diameter of its cross bar 72 automatically with out the need for adding and removing sleeves 22. Goal post 70 includes a thin sleeve 74 substantially similar to sleeve 64 of goal post 60. Sleeve 74 has a longer length and extends entirely from upright 20 to goose neck 12 as shown in FIG. 9. Cross bar 72 includes an intermediate sleeve 76 of the same thickness as sleeve 74. Sleeve 74 abuts intermediate sleeve 76 when cross bar 72 is in the retracted position. Otherwise, sleeve 74 functions the same as sleeve 64 to maintain a substantially constant diameter in cross bar 72 in the retracted and extended positions. As shown in FIG. 9, sleeve 74 includes at least one hole 77 that allows access to pin 34. Sleeve 74 may also include a pair of holes 77.

In each of the embodiments discussed above, the left and right halves of the goal posts are substantially identical. In addition, sleeves 22, 64, or 74 may be used in conjunction with any of the following embodiments without departing from the concepts of the present invention. The use of sleeves 22, 64, and 74 has thus only been described with respect to the embodiments above and it being understood that those skilled in the art may apply the use of sleeves 22, 64, or 74 to any of the following embodiments.

Figures 12, 12A:
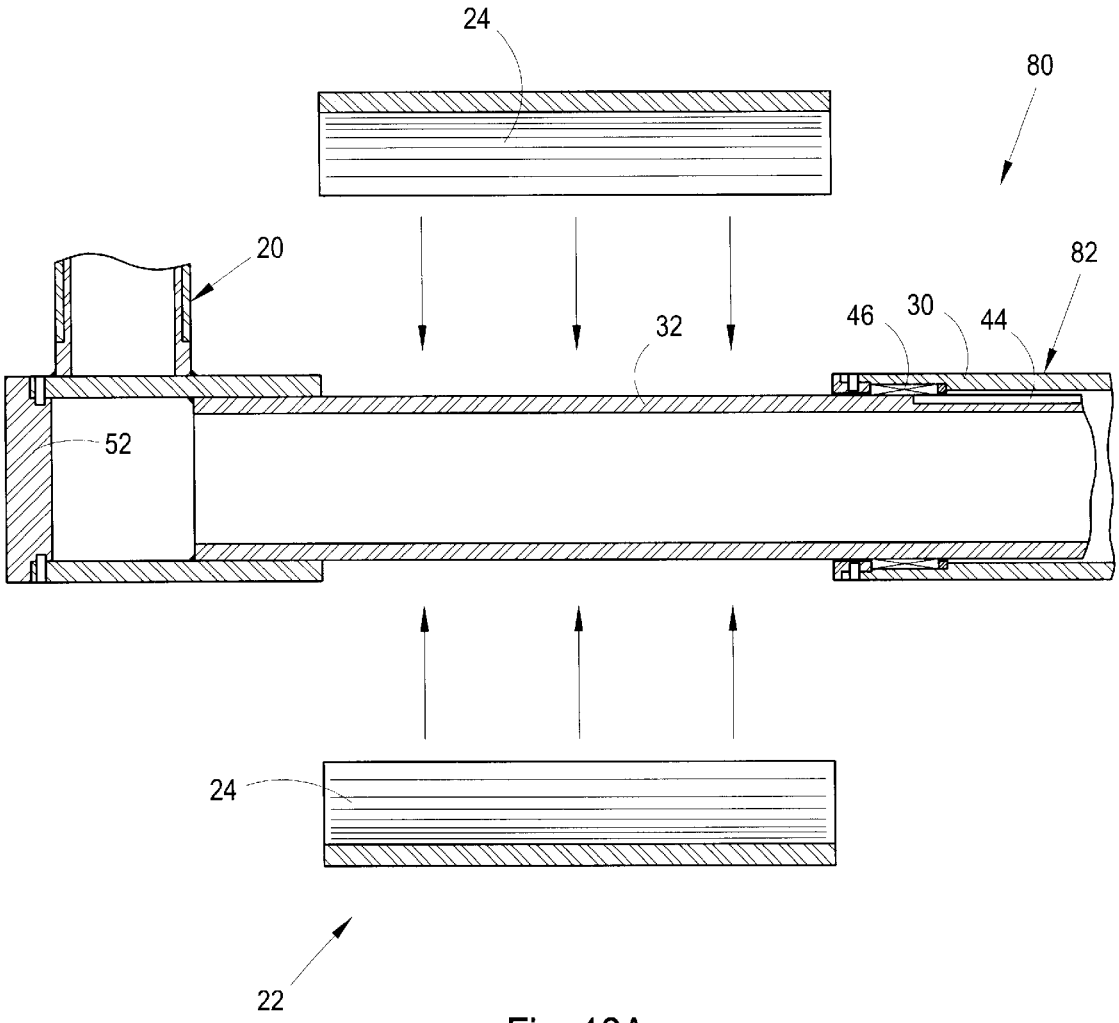
FIG. 12 includes FIGS. 12A and 12B.
FIG. 12A is a sectional view showing the fourth embodiment in an extended position with the sleeves being installed.
Figure 12B:
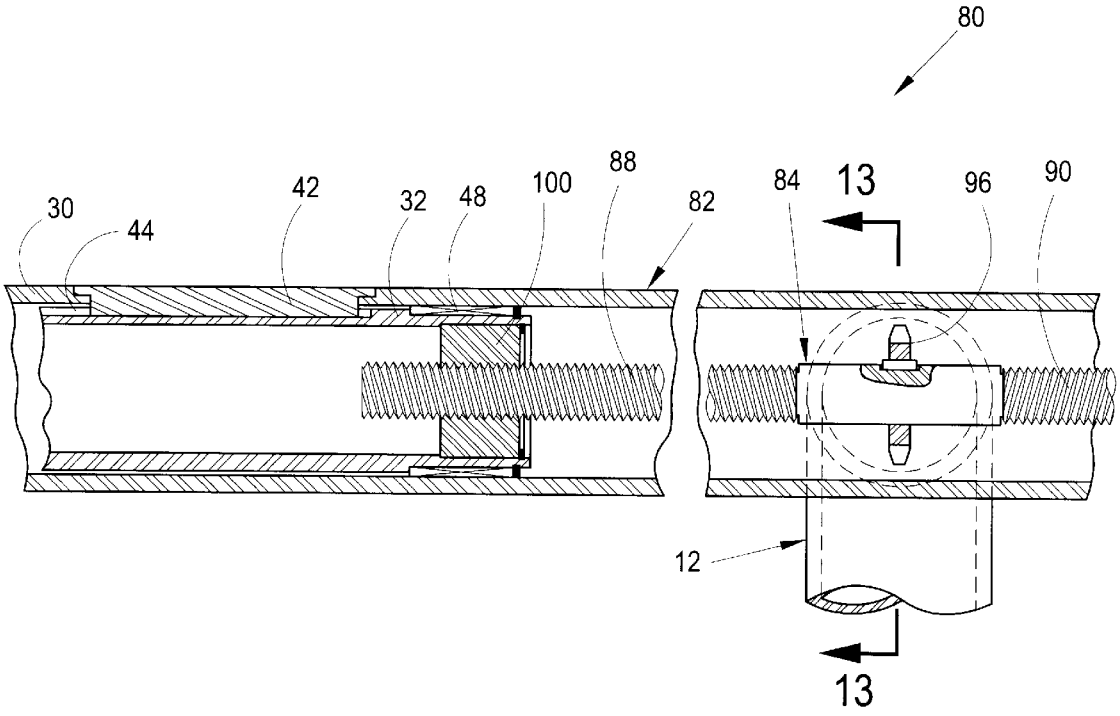
FIG. 12B is a sectional view of the middle portion of the fourth embodiment of the adjustable cross bar component in an extended position.
Figure 13:
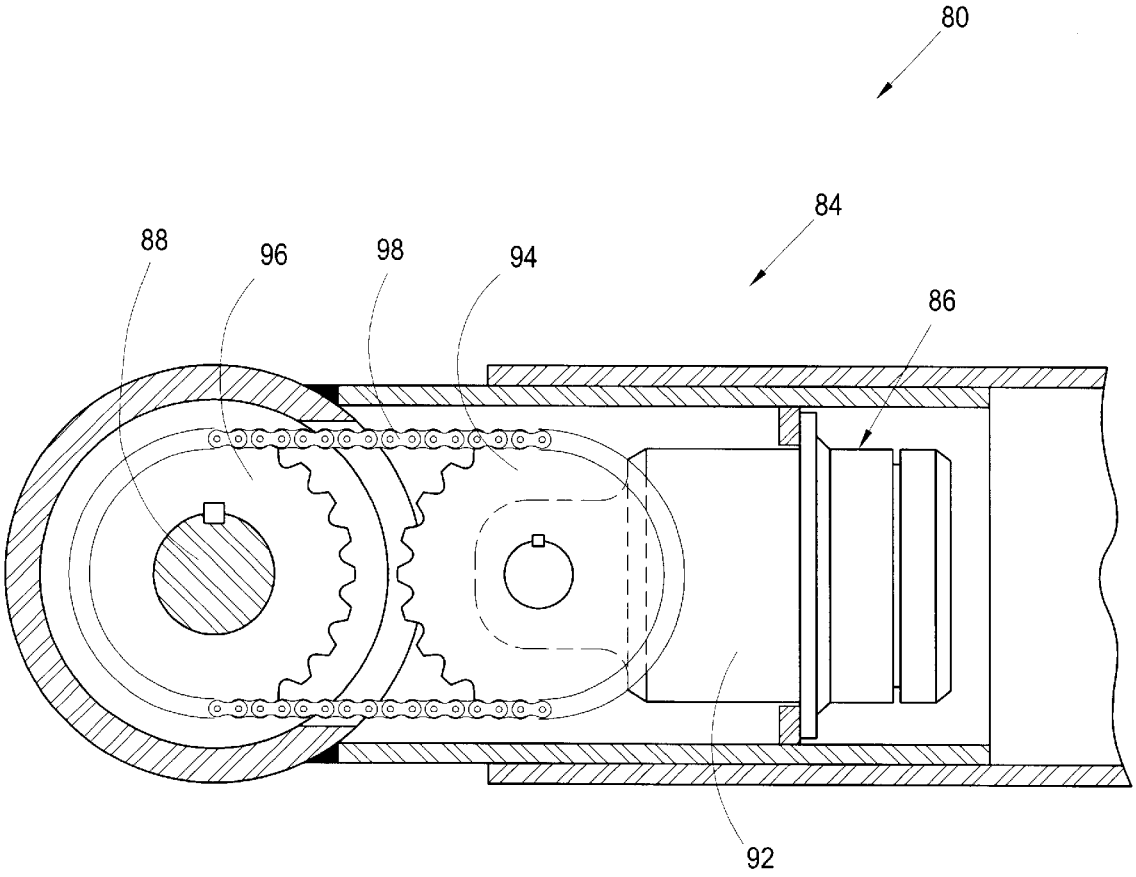
FIG. 13 is a sectional view taken along line 13—13 of FIG. 12B.

The fourth embodiment of the goal post of the present invention is indicated generally by the numeral 80 in FIGS. 11–13. Goal post 80 includes a cross bar 82 that may be automatically moved between the retracted and extended positions and back from the extended position to the retracted position. Another feature of cross bar 82 is that both uprights 20 move simultaneously in response to a single input. Cross bar 82 includes many of the same elements described above and the same numbers are used to refer to these elements. Cross bar 82 further includes a mechanism 84 that allows each second member 32 to be simultaneously adjusted. Mechanism 84 includes a drive 86 and a screw 88. Screw 88 includes a pair of oppositely extending, oppositely-threaded screw portions 90 that extend inside second member 32. Drive 86 may be any of a variety of drives known in the art that are operable to cause screw 88 to rotate in selected directions. In the embodiment depicted in the drawings, drive 86 includes a motor 92, a drive gear 94 connected to the motor, and a following gear 96 connected to screw 88. Although drive gear 94 and following gear 96 may meshingly engage, a linkage 98, such as the chain depicted in FIG. 13 may be used to provide the connection between motor 92 and screw 88. It is understood that various other types of drive mechanisms may be used to drive screw 88. For instance, drive mechanism 84 may be a manual system wherein a hand crank is inserted into a portion of goal post 80 to turn screw 88. Drive mechanism 84 may include essentially any type of device known to those skilled in the art to drive screw 88. The controls for mechanism 84 may be mounted on goal post 80 or at a remote location. The controls may be hard wired to mechanism 84 or connected to mechanism 84 via radio frequency (RF) waves.

Each second member 32 of cross bar 82 includes a threaded block 100 that is connected to and moves with second member 32. Each threaded screw portion 90 threadedly engages threaded block 100 so that rotation of screw 88 causes blocks 100 to move longitudinally along screw 88. Key 42 and keyway 44 prevent second members 32 from rotating and blocks 100 are non-rotatably connected to second members 32 to prevent blocks 100 from rotating. As such, rotation of screw 88 drives blocks 100 toward and away from goose neck 12.

FIG. 11 depicts cross bar 82 in the retracted position. Actuation of mechanism 84 drives second members 32 outwardly to the extended position depicted in FIG. 12. As described above, sleeves 22 may then be connected to cross bar 82 to maintain the constant diameter of cross bar 82. Cross bar 82 may then be moved back from the extended position to the retracted position by actuating mechanism 84 in the opposite direction.

Figures 14, 14A:
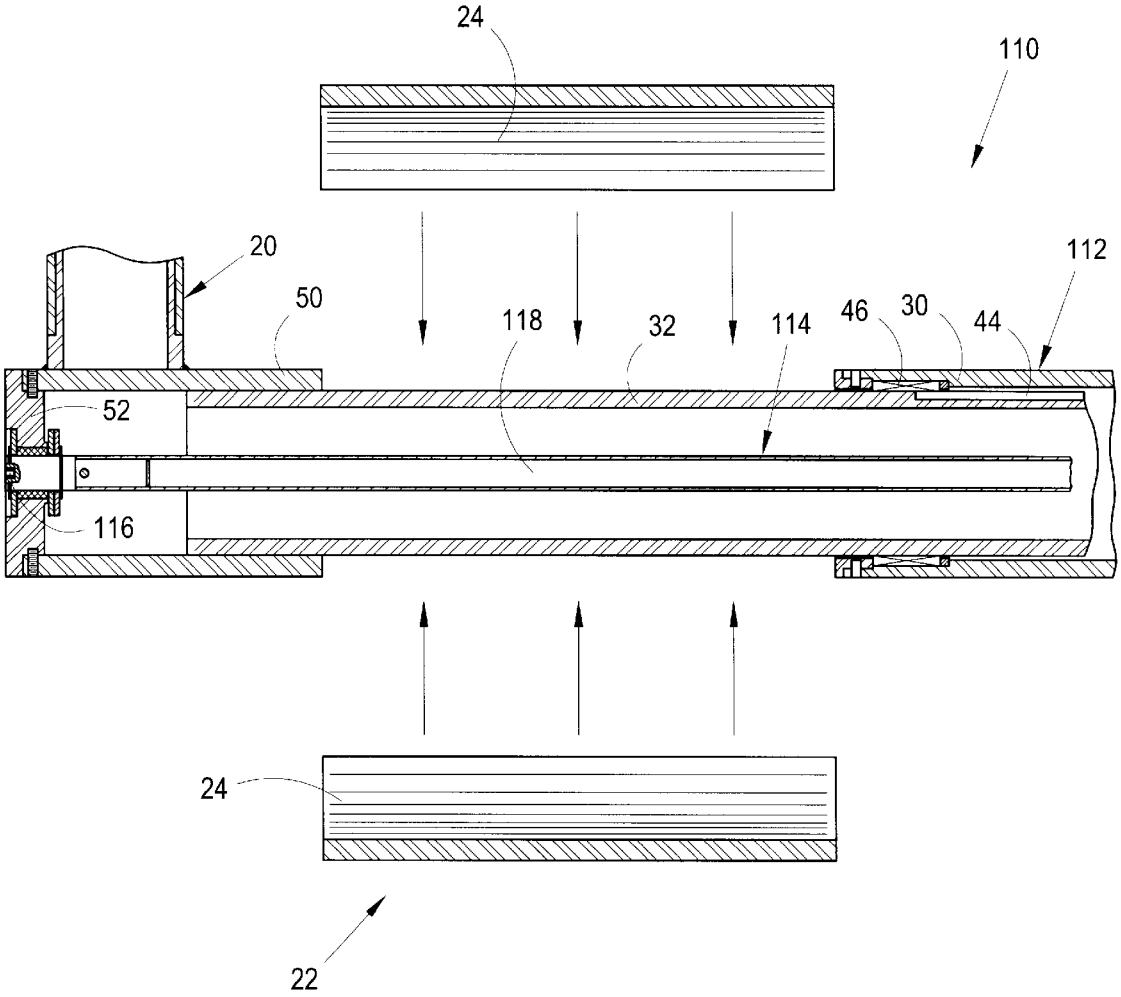
FIG. 14 includes FIGS. 14A, 14B, and 14C.
FIG. 14A is a sectional view of the end of the fifth embodiment of the adjustable cross bar component showing the sleeves being installed.
Figure 15:
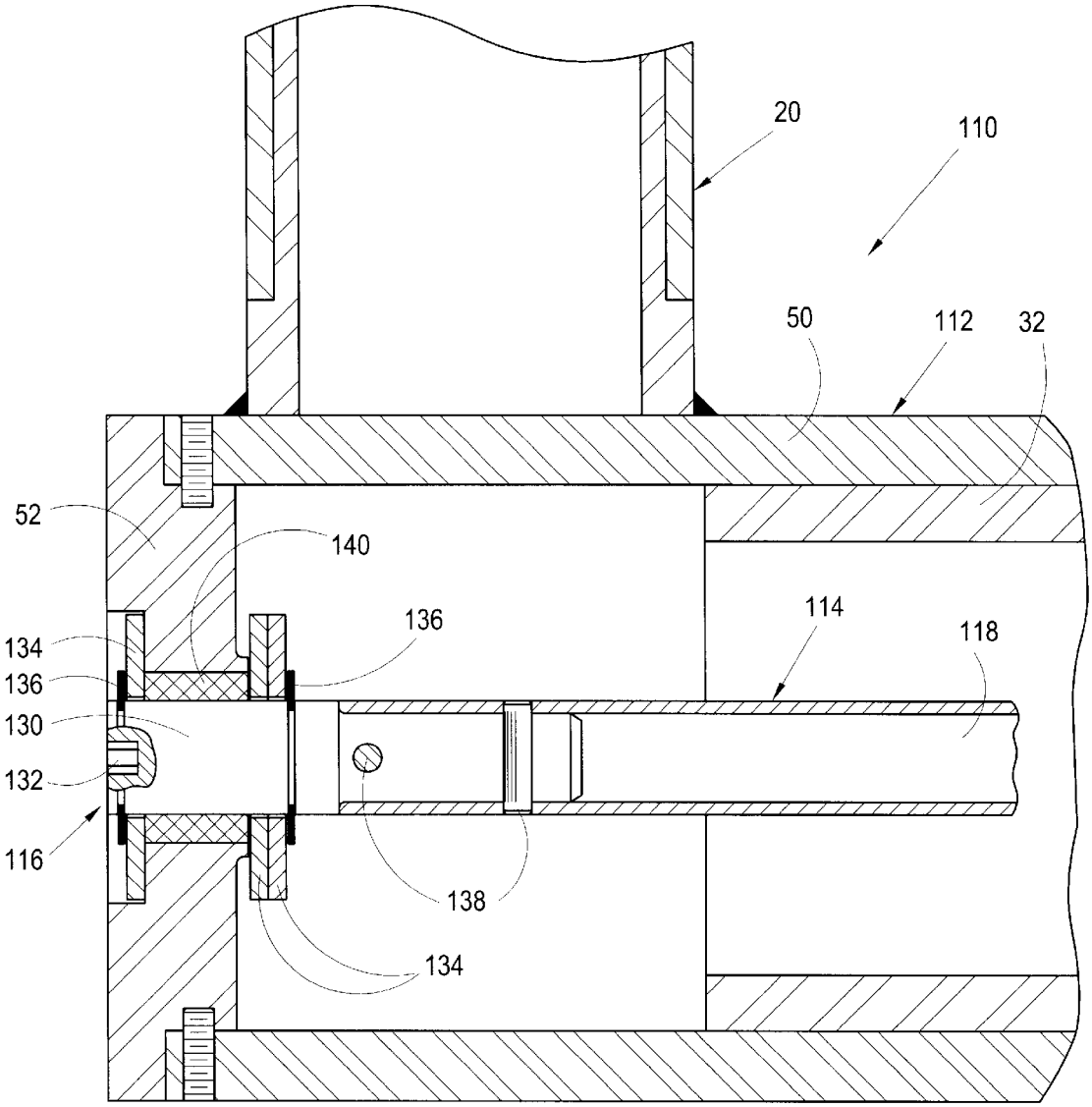
FIG. 15 is an enlarged sectional view of the end of the fifth embodiment of the adjustable cross bar component.
Figure 16:
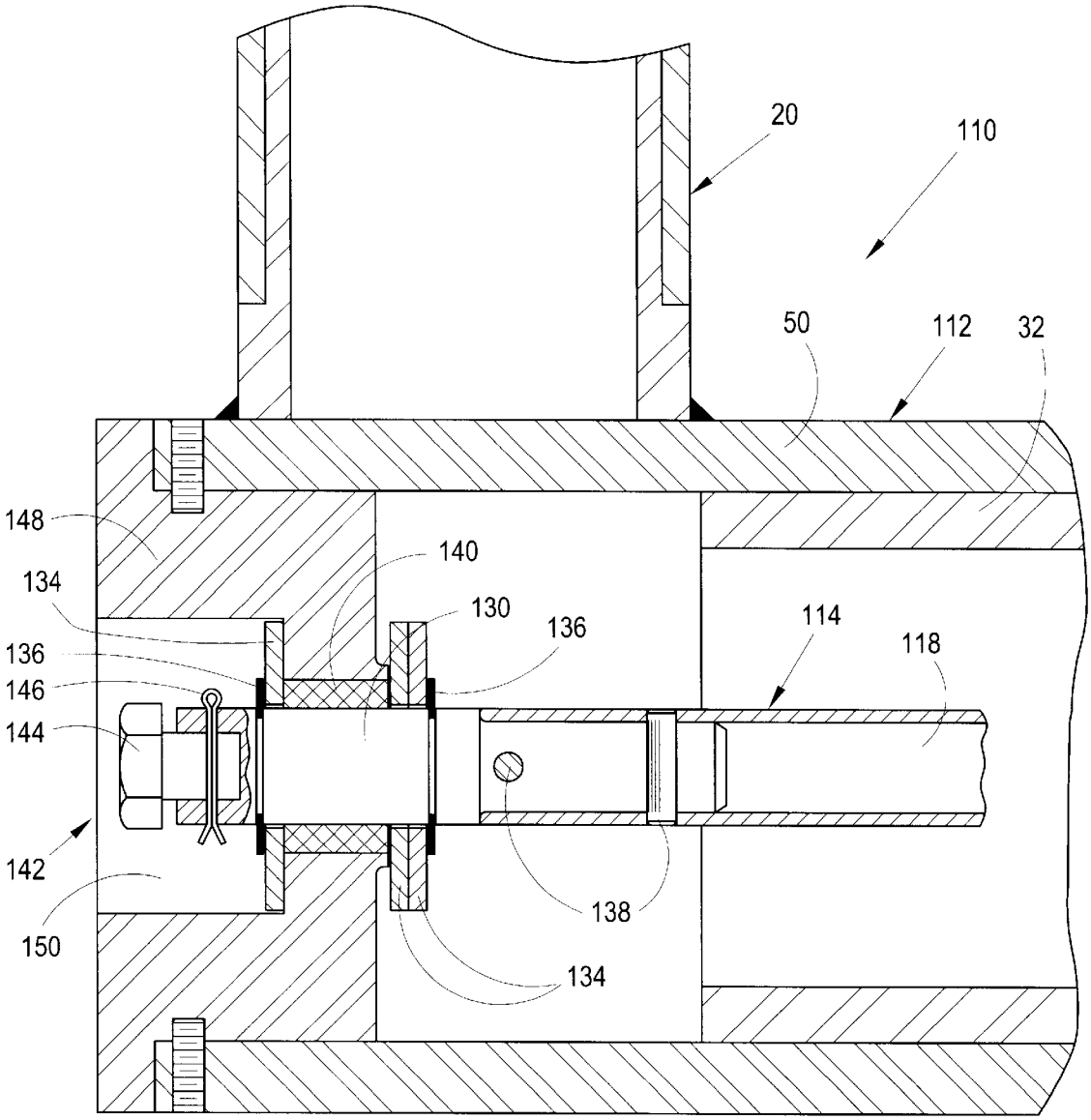
FIG. 16 is a view similar to FIG. 15 showing an alternative configuration to the fifth embodiment of the adjustable cross bar component.

The fifth embodiment of the goal post of the present invention is indicated generally by the numeral 110 in FIGS. 14–16. Goal post 110 includes an adjustable cross bar 112 that allows the spacing of uprights 20 to be selectively adjusted. Goal post 110 includes a pair of adjustment mechanisms 114 disposed in either half of cross bar 112. Adjustment mechanism 114 includes an input device 116, a connecting shaft 118, a support block 120, a threaded shaft 122, and a threaded block 124. In general, the user of goal post 110 supplies rotary motion to input device 116 which causes threaded shaft 122 to rotate with respect to threaded block 124. Threaded block 124 is fixed with respect to first member 30 such that threaded shaft 122 moves longitudinally with respect to first member 30. The movement of threaded shaft 122 is translated through connecting shaft 118 back to input device 116 which is connected to end plate 52 of second member 32. The longitudinal movement of threaded shaft 122 thus causes second member 32 to move longitudinally with respect to goose neck 12.

Threaded block 124 may be fixed to first member 30 by being connected to a ground plate 126 that is connected to the end of a fixed sleeve 128. Ground plate 126 may rest against a shoulder formed in first member 30. Otherwise, ground plate 126 may be connected to first member 30 by means such as welding, bolting, pinning, keying, etc.

Input device 116 may be more clearly viewed in FIG. 15. Input device 116 includes an input shaft 130 that includes an input cavity 132 that is adapted to receive a corresponding wrench to allow input shaft 130 to be rotated. The position of input shaft 130 is fixed with respect to end plate 52 by a plurality of washers 134. Washers 134 are held in place by appropriate connectors 136 such as snap rings. Input shaft 130 is connected to connecting shaft 118 by a pair of pins 138 in the preferred embodiment of the invention. In other embodiments, connectors other than pins 138 may be used without departing from the concepts of the present invention. A bearing 140 rotatably supports input shaft 130 with respect to end plate 52.

An alternative configuration of the input device in the fifth embodiment of the goal post is depicted in FIG. 16 and is indicated generally by the numeral 142. Input device 142 includes essentially the same elements as input device 116 with the exception that an input bolt 144 is connected to input shaft 130. The connection between input bolt 144 and input shaft 130 is designed to be the weakest connection of adjustment mechanism 114 so that it will break before any other connection of adjustment mechanism 114 breaks if an element of cross bar 112 becomes jammed. In the embodiment of the invention depicted in FIG. 16, a pin 146 is used to form the connection between input bolt 144 and input shaft 130. The end plate 148 is also modified to include a cavity 150 that receives bolt 144. Cavity 150 prevents bolt 144 from protruding beyond the end surface of end plate 148 for safety and aesthetic reasons.

Support block 120 is fixed with respect to second member 32. Support block 120 may be fixed in place by abutting it against a shoulder formed in second member 32 and using a connector 152 to maintain the position of block 120 in the other direction. In other embodiments, support block 120 may be connected to second member 32 by other appropriate connectors such as welds, bolts, pins, or keys. Support block 120 includes a bearing 154 that is held in support block 120 with appropriate connectors 156.

Figure 14B:
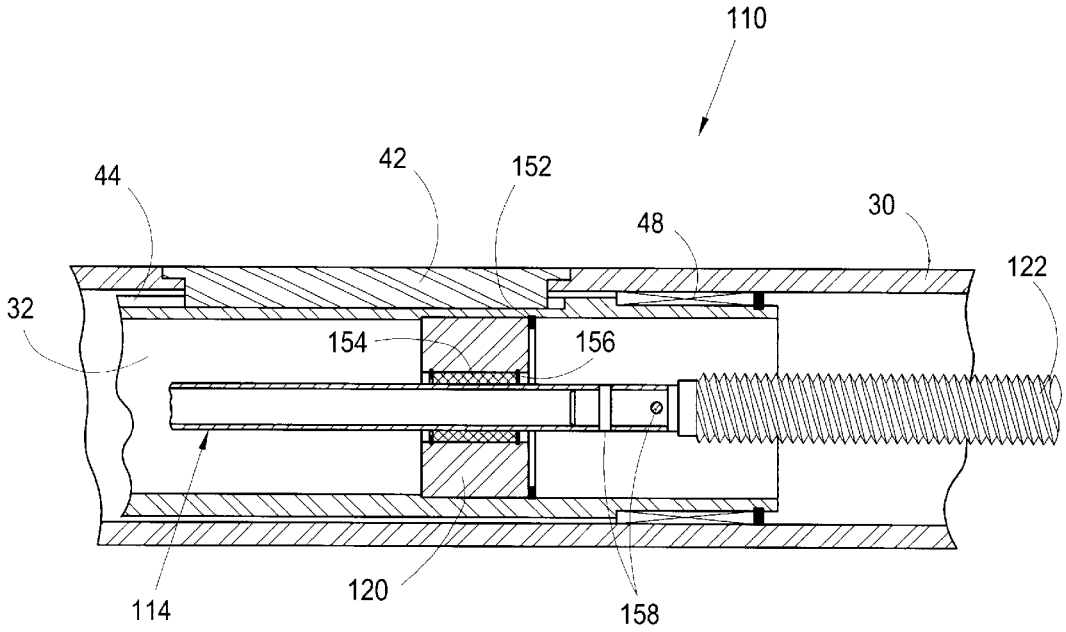
FIG. 14B is a sectional view of an intermediate portion of the fifth embodiment of the adjustable cross bar component.

Connecting shaft 118 may be connected to threaded shaft 122 by an appropriate connector such as the pin connectors 158 depicted in FIG. 14B. In other embodiments of the invention, connecting shaft 118 may be integrally formed with threaded shaft 122 or connected to shaft 122 by other appropriate connectors known in the art.

Figure 14C:
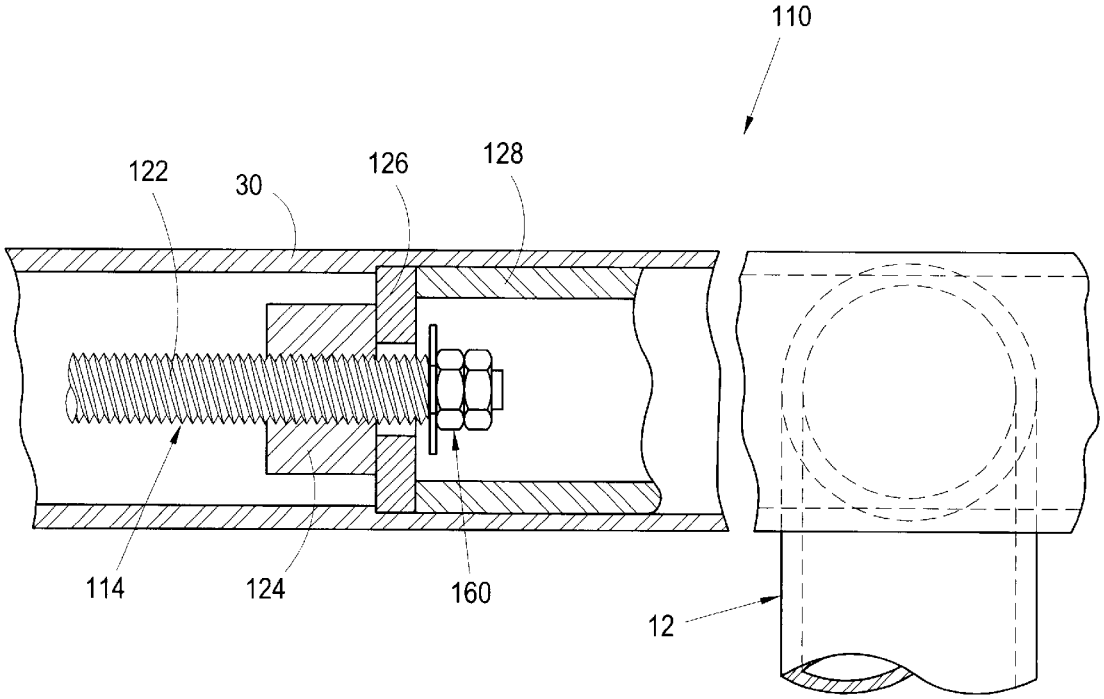
FIG. 14C is a view, partially in section, of the middle portion of the fifth embodiment of the adjustable cross bar component.

The inner end of threaded shaft 122 includes a stop 160 that prevents shaft 122 from being extended too far. In the embodiment depicted in FIG. 14C, stop 160 includes a washer and a pair of bolts connected to the end of threaded shaft 122.

Figures 17, 17A:
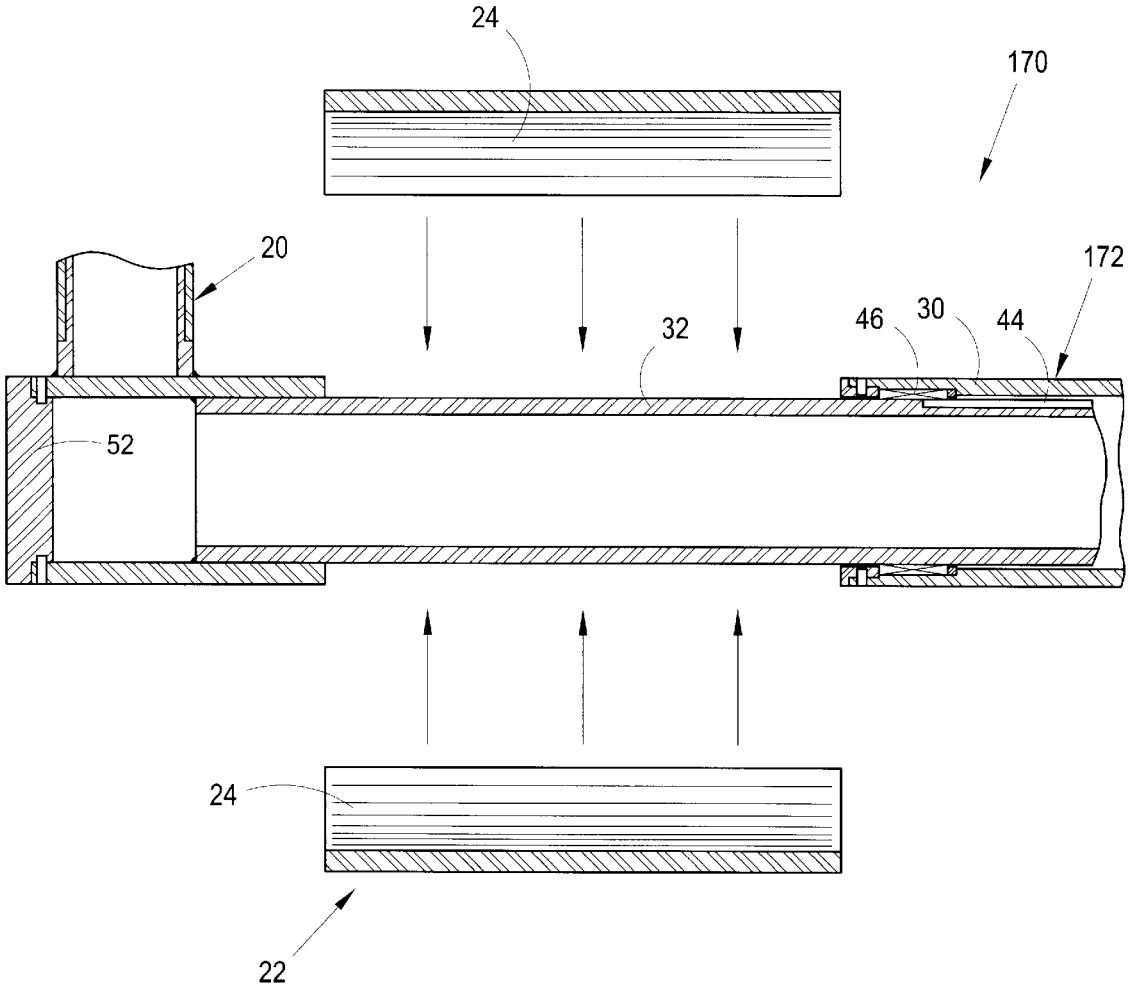
FIG. 17 includes FIGS. 17A; 17B, and 17C.
FIG. 17A is a sectional view of the end portion of the sixth embodiment of the adjustable cross bar component showing the sleeves being installed.
Figure 17B:
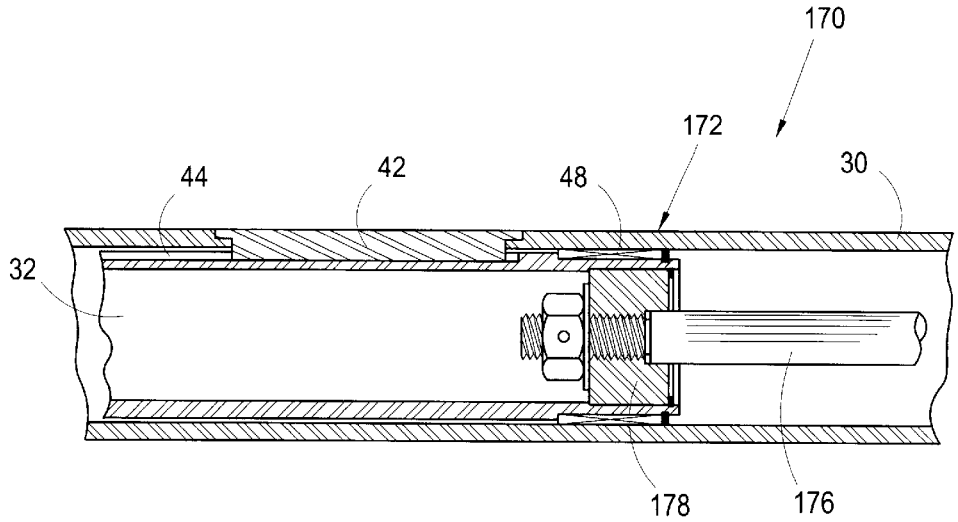
FIG. 17B is a sectional view of an intermediate portion of the sixth embodiment of the adjustable cross bar component.
Figure 18:
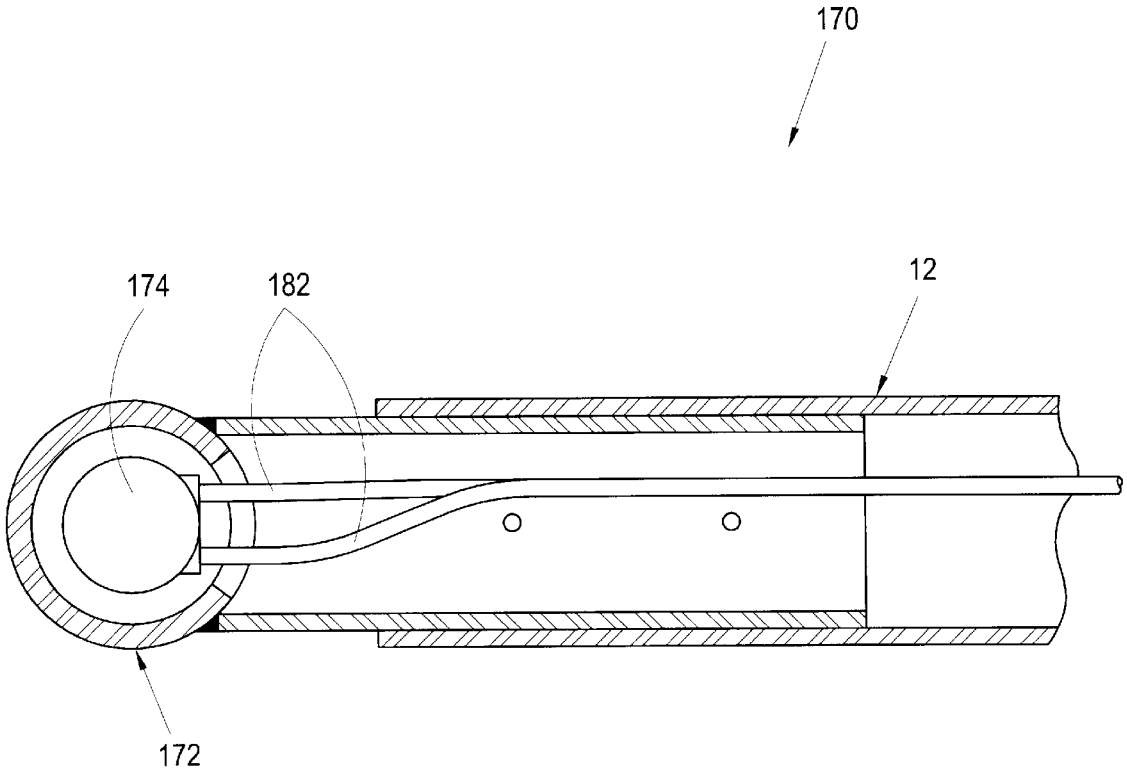
FIG. 18 is a sectional view taken along line 18—18 of FIG. 17C.
Figure 19:
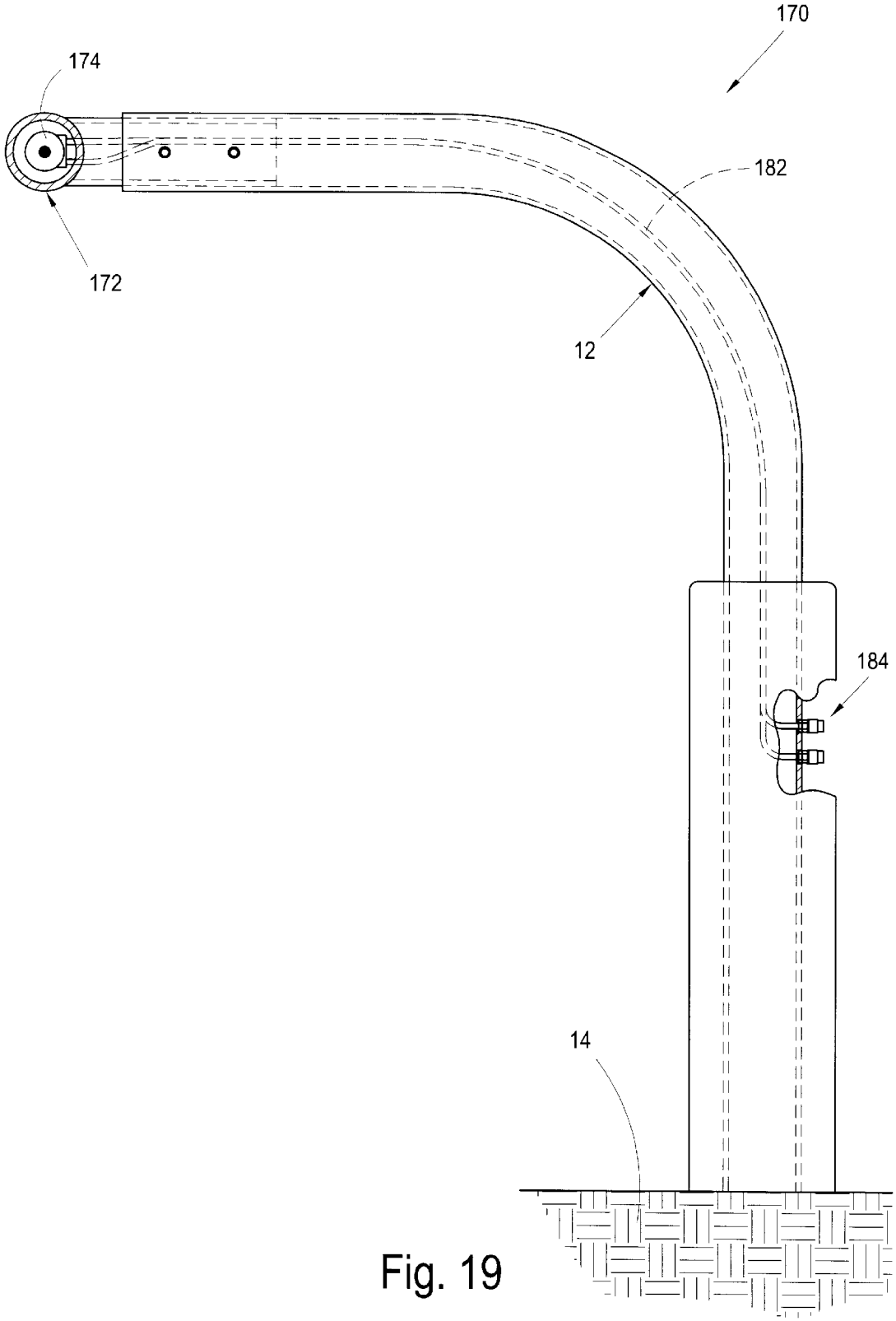
FIG. 19 is a side view, partially in section, of the goose neck of the sixth embodiment of the invention.

The sixth embodiment of the goal post of the present invention is indicated generally by the numeral 170 in FIGS. 17–19. Goal post 170 includes many of the same elements as goal post 10 and the same numbers are used to refer to those elements. Goal post 170 includes a cross bar 172 that is adjustable between the retracted and extended positions. Cross bar 172 is moved between the extended and retracted positions by a pair of linear actuators 174. In another embodiment, a single actuator 174 may be disposed between both second members 32. Linear actuators 174 may be hydraulic, pneumatic, or electric. Each linear actuator 174 includes a drive shaft 176 connected to second member 32. The base 177 of each linear actuator 174 is connected to first member 30 so that relative movement between first and second members 30 and 32 may be achieved.

Drive shaft 176 may be threaded to a block 178 that is connected to the end of second member 32. Block 178 may be connected to second member 32 by abutting block 178 against a shoulder formed in second member 32 or by connecting block 178 with appropriate connectors such as welds, bolts, pins, keys, or the like. The connection between drive shaft 176 and block 178 may be made in a variety of ways known in the art.

Figure 17C:
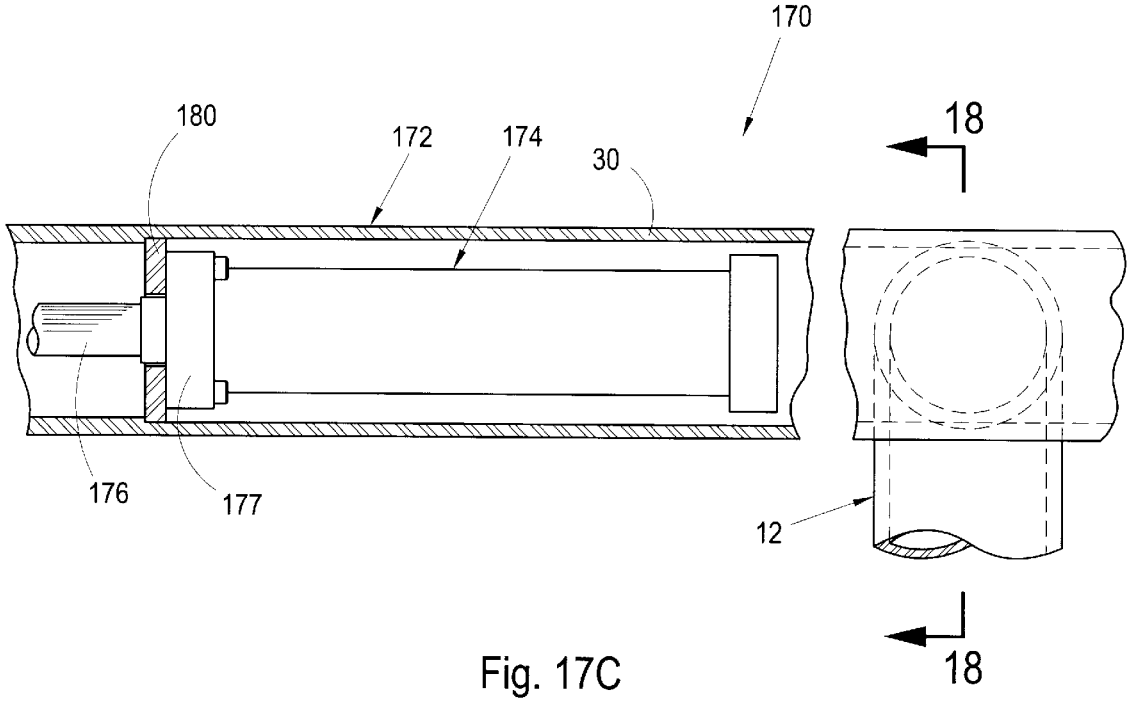
FIG. 17C is a view, partially in section, of the middle portion of the sixth embodiment of the adjustable cross bar component.

Linear actuator 174 may be connected to first member 30 in any of a variety of ways known in the art. For instance, a plate 180 may be connected to first member 30 at a shoulder as shown in FIG. 17C. In other embodiments, plate 180 may be connected by welds, bolts, or other suitable connectors known in the art.

Each linear actuator 174 is connected to a source of air, electricity, or hydraulic fluid (not shown) by a supply line 182 that extends between linear actuator 174 and the appropriate supply of fluid. As shown in FIG. 19, lines 182 may extend down goose neck 12 to a connection area 184 where the user of goal post 170 may selectively connect and disconnect the supply of fluid used to actuate linear actuators 174. In other embodiments, lines 182 may be permanently connected to the supply of fluid with a controller selectively supplying the fluid to linear actuators 174.

Figures 20, 20A:
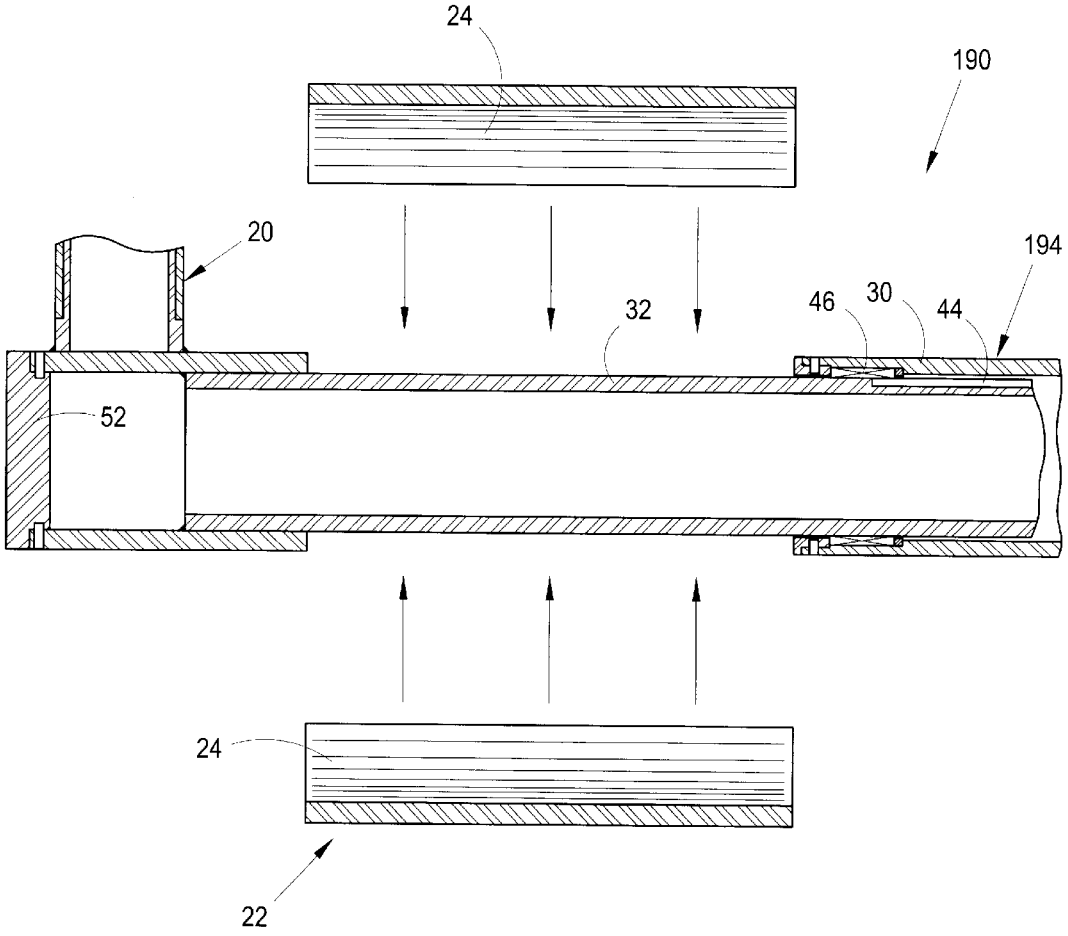
FIG. 20 includes FIGS. 20A, 20B, and 20C.
FIG. 20A is a sectional view of the end portion of the seventh embodiment of the adjustable cross bar component.

The seventh embodiment of the goal post of the present invention is indicated generally by the numeral 190 in FIG. 20. Goal post 190 operates similar to goal post 170 except that a pair of powered jacks 192 are substituted for linear actuators 174. The cross bar 194 of goal post 190 thus includes a pair of power jacks 192 that may be individually or simultaneously used to adjust the spacing of uprights 20. Each power jack is operable to selectively extend and retract a drive shaft 196 that is connected to second member 32 in a manner similar to drive shaft 176 discussed above. One type of powerjack 192 that will function with goal post 190 is sold under the Trademark Pow-R-Jac®. Each power jack 192 may be connected to a power source via a conventional hardwire mechanism or may be connected to a battery and a controller allowing each power jack 192 to be remotely operated. In another embodiment, each power jack 192 may be hardwired to a power source with a controller disposed at a remote location allowing each power jack 192 to be selectively actuated.

Figure 20B:
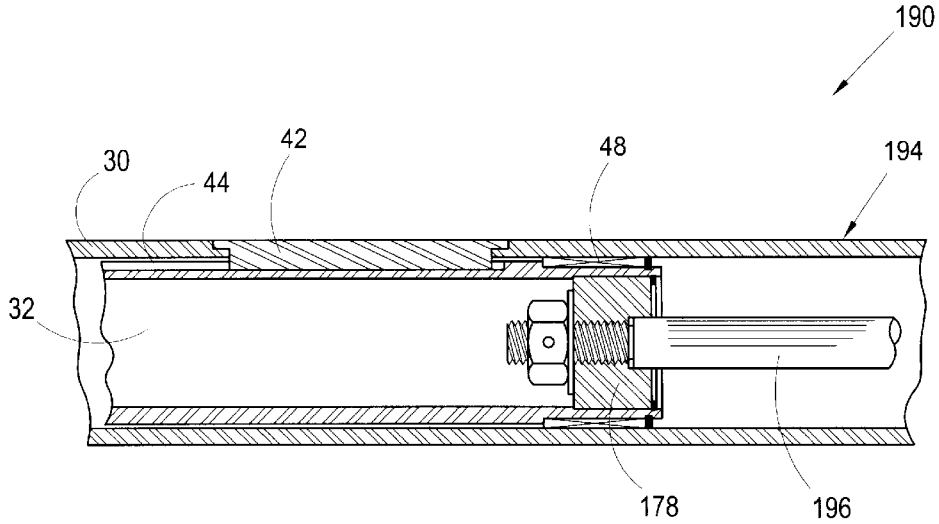
FIG. 20C is a view, partially in section, of the middle portion of the seventh embodiment of the adjustable cross bar component.
Figure 20C:
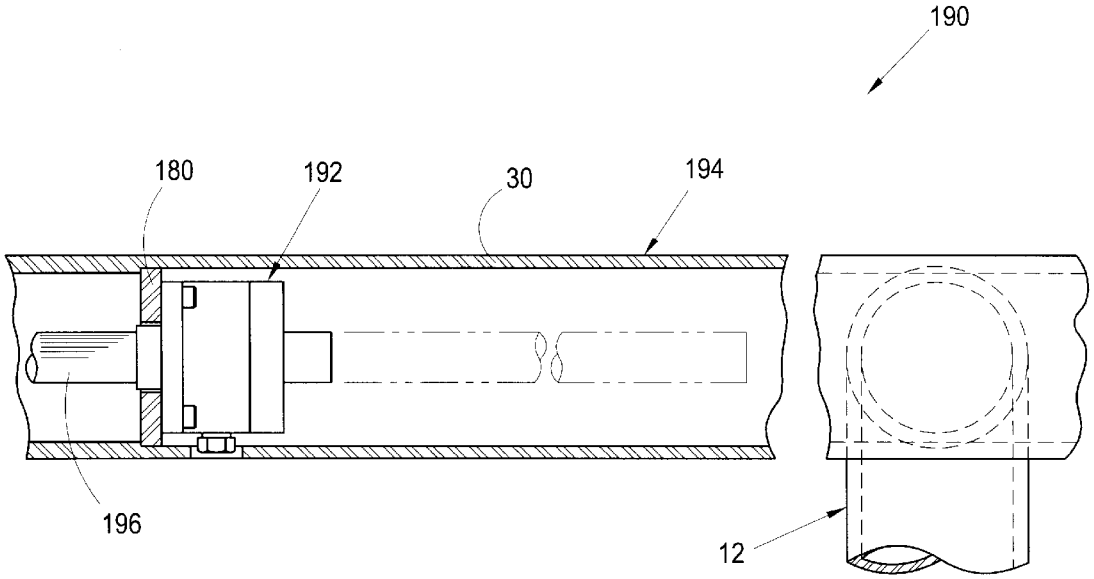

In operation, power jack 192 rotates internal elements to cause drive shaft 196 to extend and retract. The end of drive shaft 196 is connected to second member 32 as depicted in FIG. 20B. The movement of drive shaft 196 is thus transmitted to second element 32 and second element 32 extends and retracts with drive shaft 196.

Figures 21, 21A:
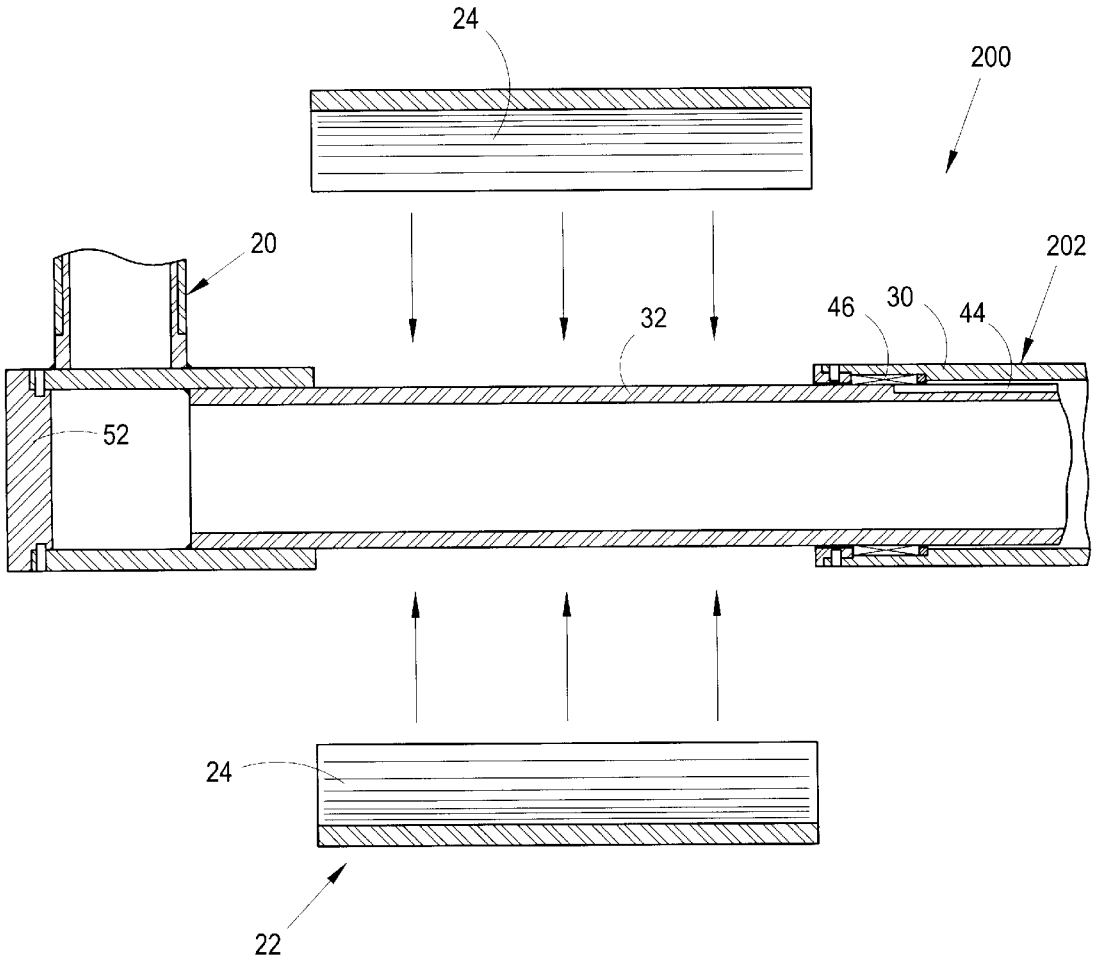
FIG. 21 includes FIGS. 21A, 21B, and 21C
FIG. 21A is a sectional view of the end portion of the eighth embodiment of the adjustable cross bar component.
Figure 21B:
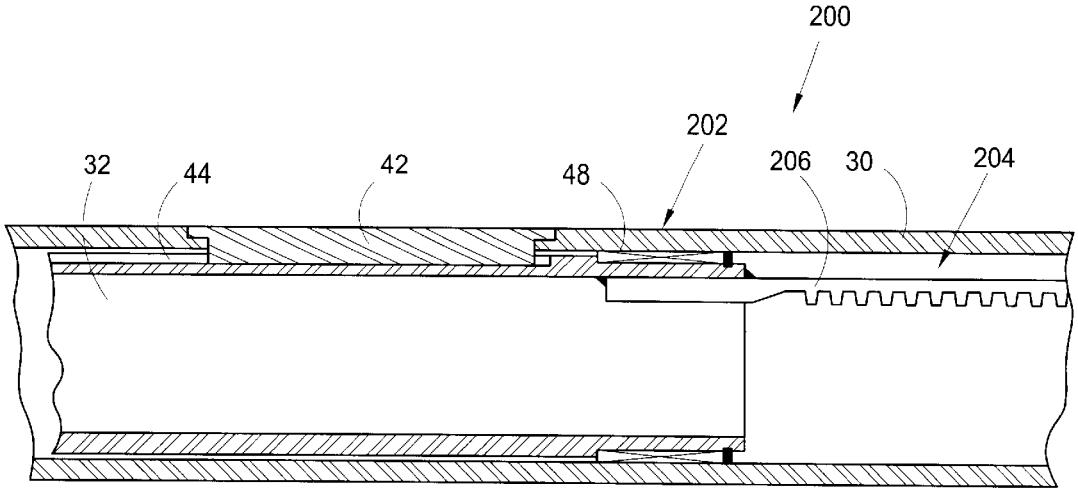
FIG. 21B is a sectional view of an intermediate portion of the eighth embodiment of the adjustable cross bar component.
Figure 21C:
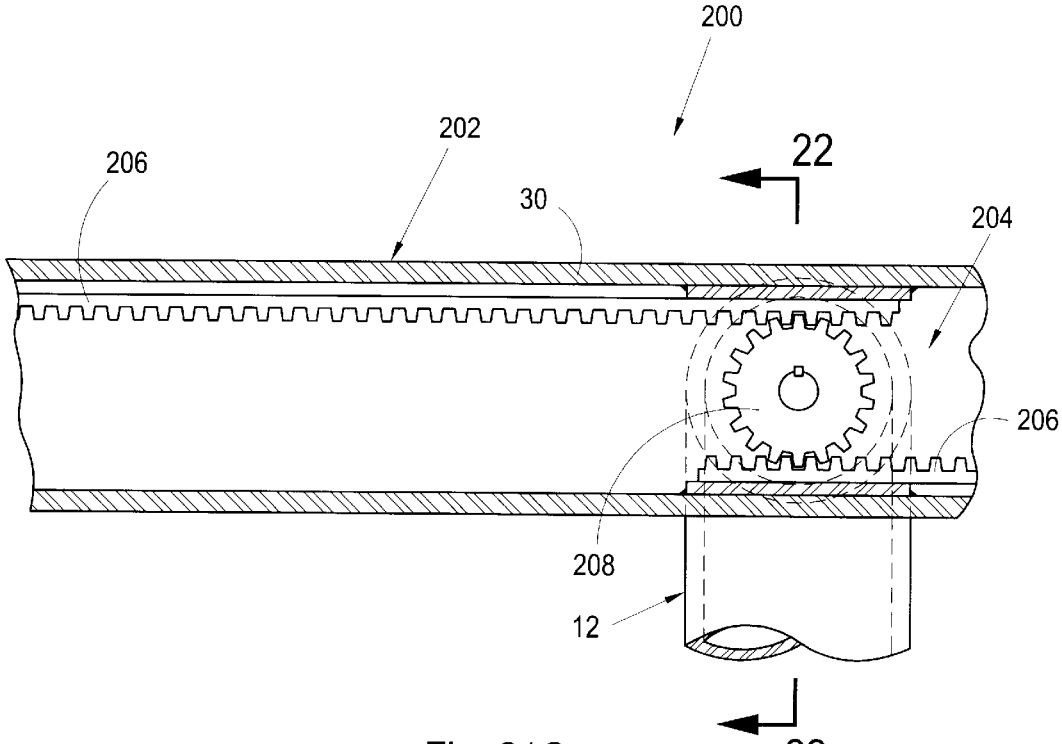
FIG. 21C is a sectional view of the middle portion of the eighth embodiment of the adjustable cross bar component.
Figure 22:
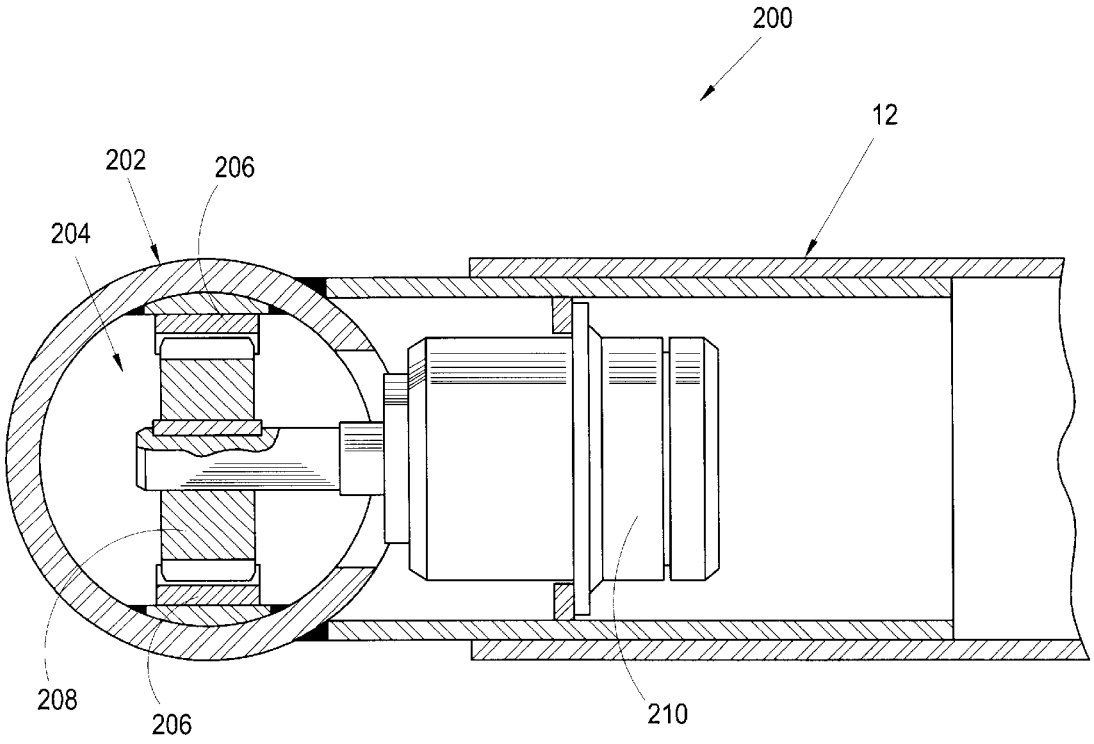
FIG. 22 is a sectional view taken along line 22—22 of FIG. 21C.

The eighth embodiment of the goal post of the present invention is indicated generally by the numeral 200 in FIGS. 21 and 22. Goal post 200 includes a cross bar 202 that is adjustable in a manner similar to cross bar 82 described above with respect to the fourth embodiment of goal post 80. In goal post 200, cross bar 202 includes a rack and pinion system 204. Rack and pinion system 204 includes a pair of racks 206 having a plurality of teeth. Each rack 206 is connected to one of second members 32 so that second members 32 move with racks 206. Each rack 206 engages a gear 208 that is selectively rotatable to drive racks 206 simultaneously between the extended and retracted positions. Gear 208 is driven by an appropriate drive mechanism such as the motor 210 depicted in FIG. 22. Gear 208 may also be driven by a manual system wherein a crank is provided in connection with gear 208.

Figure 23:
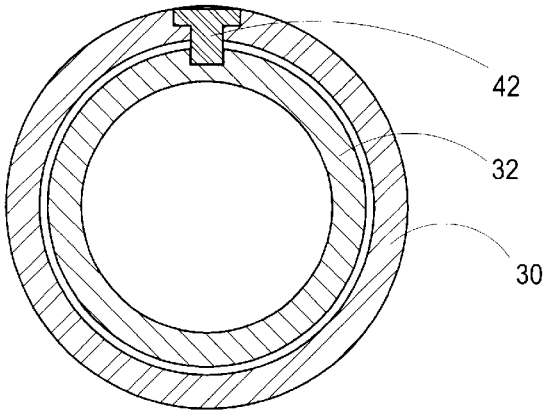
FIG. 23 is a sectional view of a first configuration for the adjustable cross bar component members.
Figure 24:
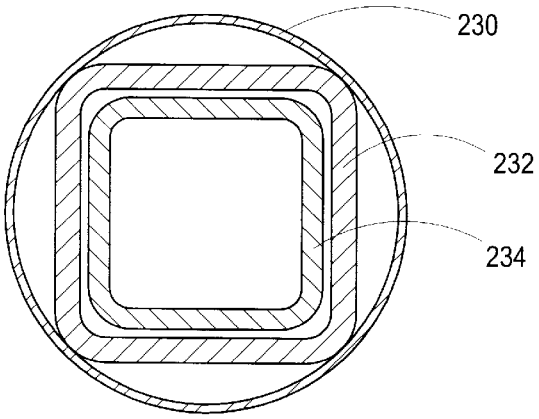
FIG. 24 is a second configuration for the adjustable cross bar component members.

In each of the above-described embodiments, key 42 and keyway 44 prevented elements 30 and 32 from rotating with respect to each other. FIG. 23 depicts a cross sectional view of key 42 holding the relative rotational positions of elements 30 and 32. Each of the above-described embodiments may alternatively use a keyless system such as the embodiment depicted in FIG. 24. In this system, first element 30 includes an outer shell 230 connected to a noncircular inner member 232. In the embodiment depicted in FIG. 24, non-circular inner member 232 has a square cross section. Second member 234 has a cross section corresponding to the non-circular cross section of non-circular inner member 232. Member 234 slides with respect to member 232 but cannot rotate because of the non-circular cross sections.

Figure 25:
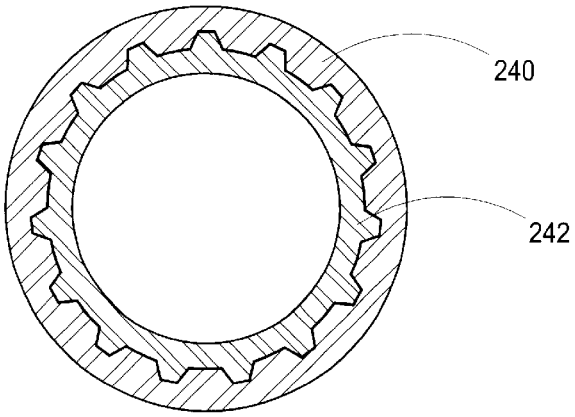
FIG. 25 is a third configuration for the adjustable cross bar component members.
Figure 26:
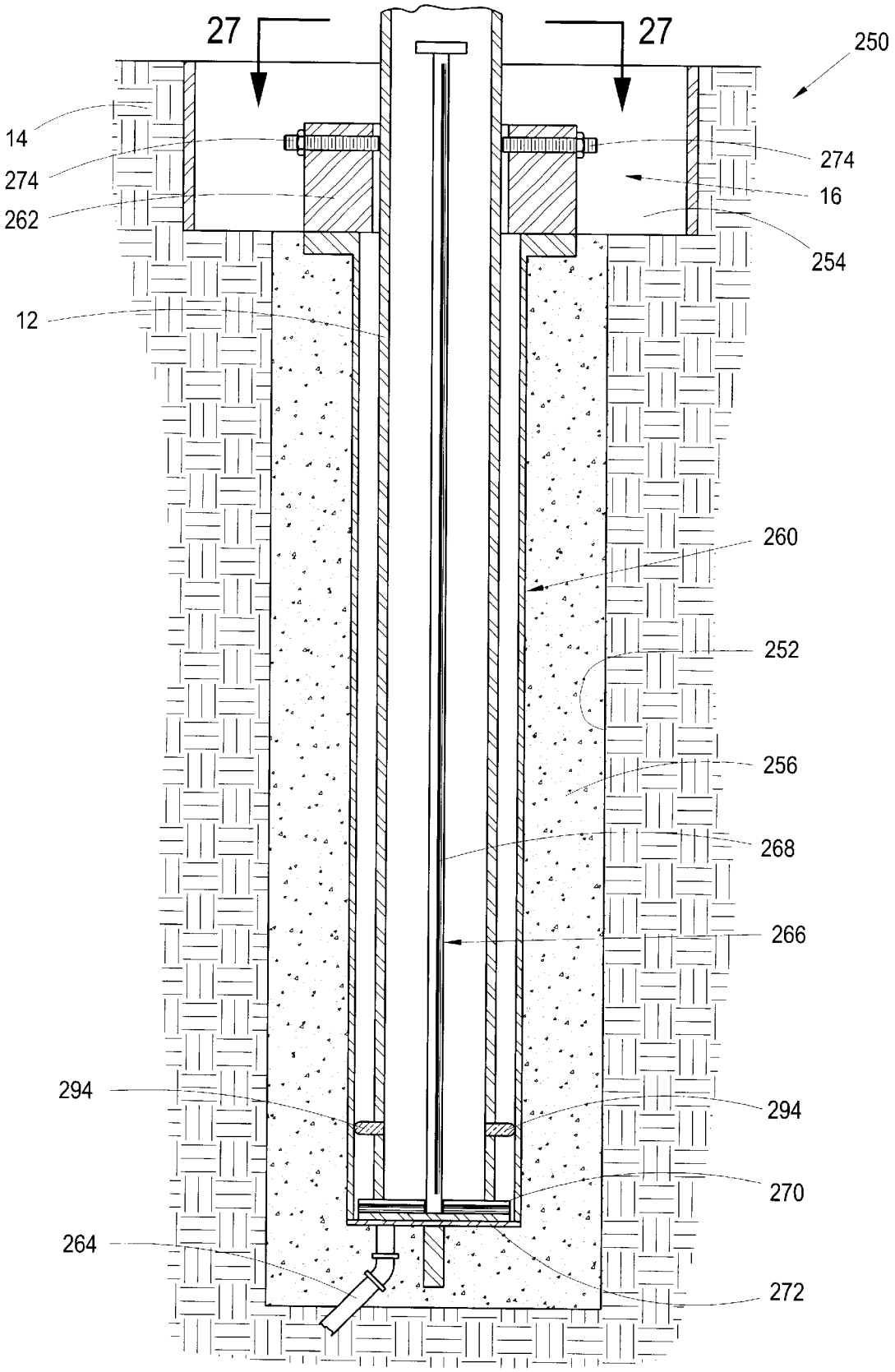
FIG. 26 is a sectional view of the first embodiment of the adjustable ground sleeve of the present invention.
Figure 27:
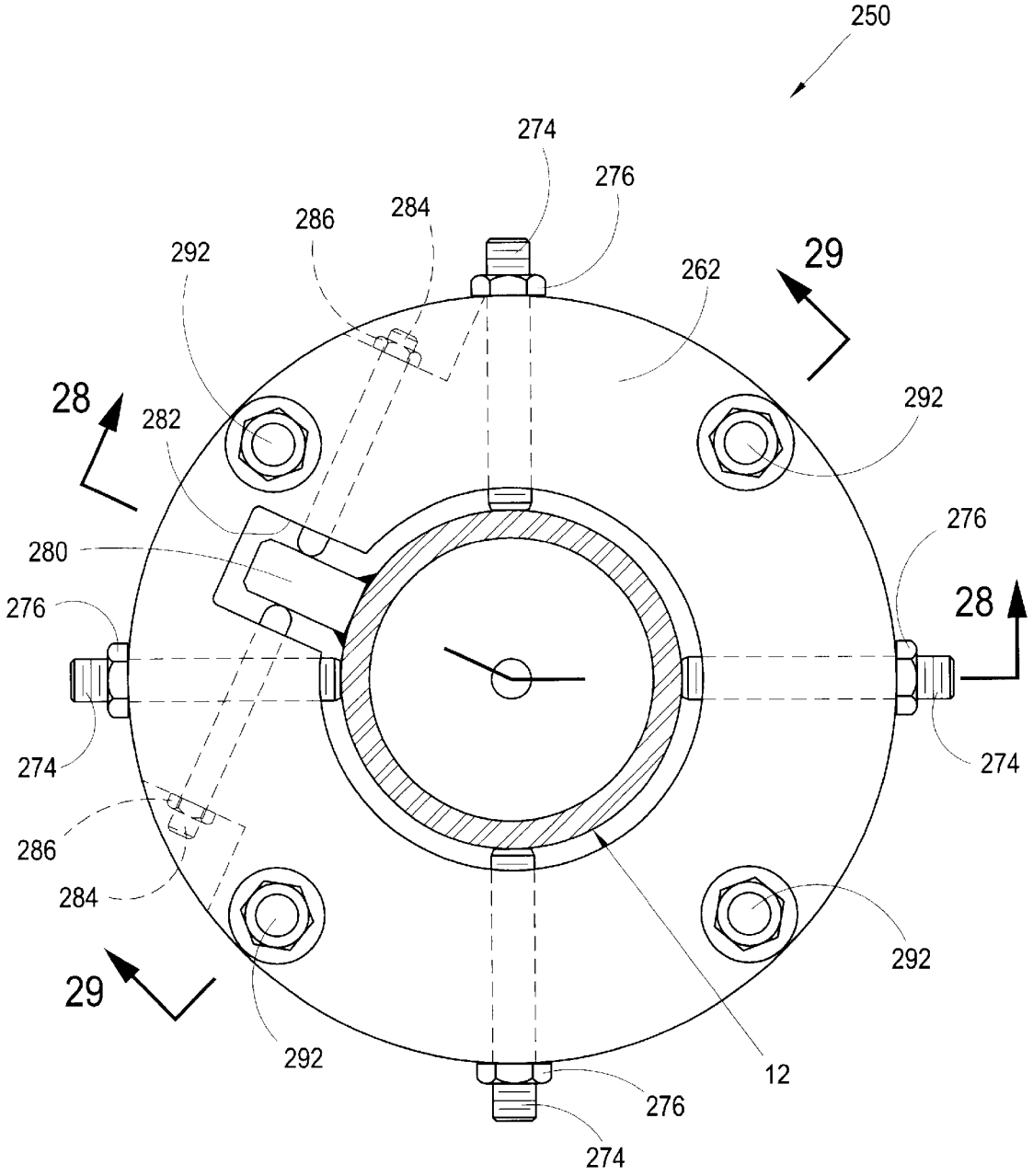
FIG. 27 is a view taken substantially along line 27—27 of FIG. 26.
Figure 28:
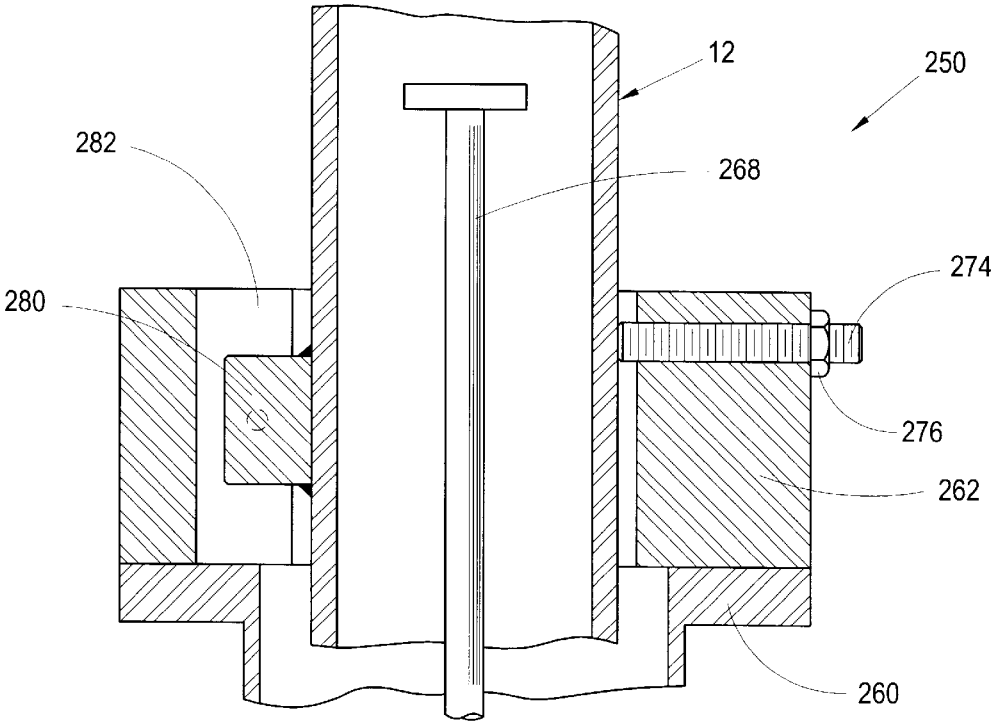
FIG. 28 is a sectional view taken along line 28—28 of FIG. 27.

An additional embodiment is depicted in FIG. 25 wherein the first member 240 includes a plurality of longitudinal slots with the second member 242 including a plurality of corresponding longitudinal ribs that fit within the slots. Again, second element 242 may slide longitudinally with respect to first member 240 but cannot rotate.

Figure 34:
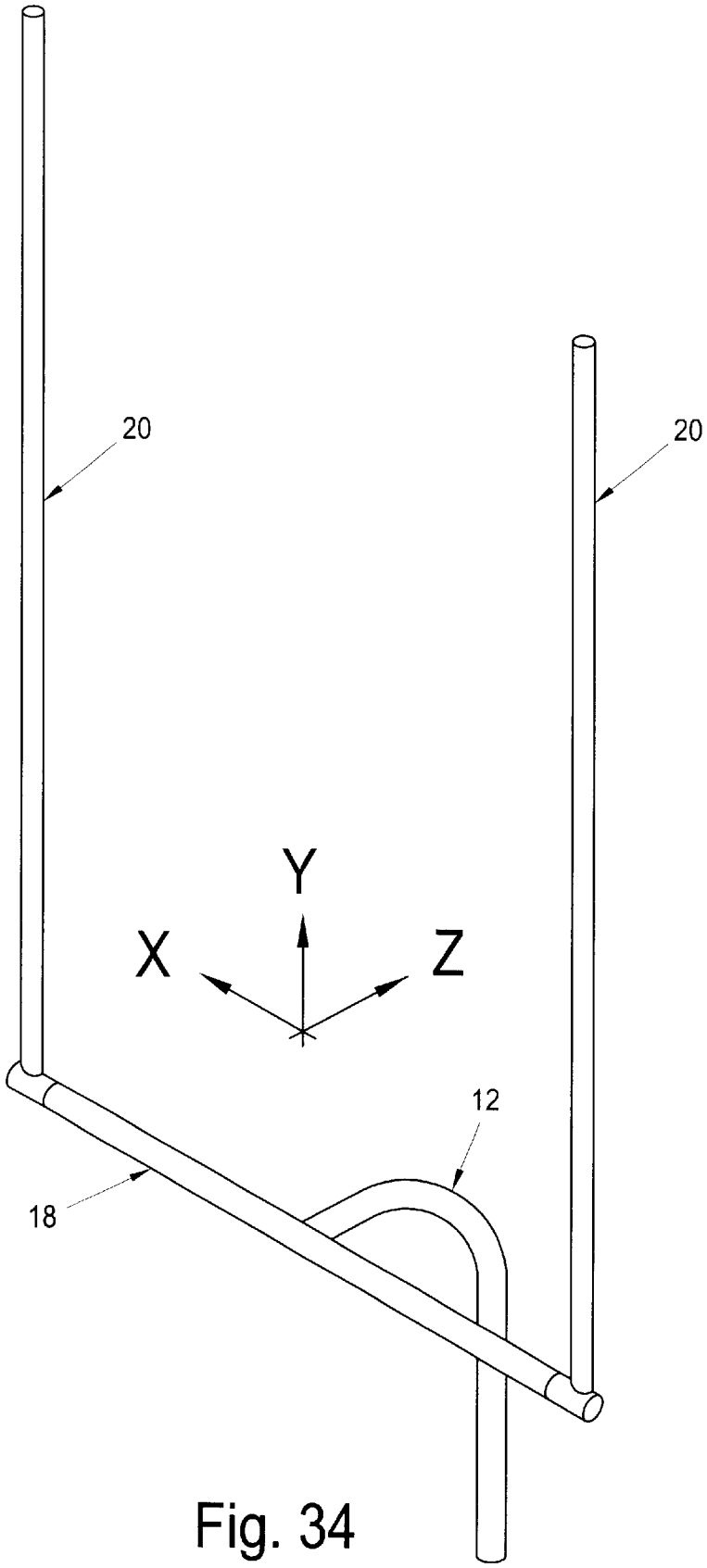
FIG. 34 is a perspective view of a football goal post in relation to the x, y, and z axes.

The first embodiment of the adjustable ground sleeve is indicated generally by the numeral 250 in FIGS. 26–29. Ground sleeve 250 receives the end of goose neck 12 in a manner that allows the height of cross bar 18 to be adjusted with respect to the upper surface of ground 14, the angle of cross bar 18 to be rotated about the y axis (see FIG. 34), the angle of cross bar 18 to be adjusted about the x axis, and the angle of cross bar 18 to be adjusted about the z axis. Adjustable ground sleeve 250 allows these adjustments to be easily accomplished so that cross bar 18 and uprights 20 may be precisely positioned with respect to the football field.

Ground sleeve 250 is installed in a hole 252 having an upper opening 254 immediately below the upper level of ground 14 that has a larger diameter than hole 252. Upper opening 254 allows the user to access adjustable ground sleeve 250 and precisely align goal post 10 with respect to the football field. Hole 252 is filled with a filler such as concrete 256 to hold adjustable ground sleeve 250 in place after it is installed.

Adjustable ground sleeve 250 generally includes a base sleeve 260 and a collar 262. Base sleeve 260 is fixed in hole 252 by filler 256. Base sleeve 260 is preferably installed substantially vertical such that its longitudinal axis is substantially parallel to the y axis. A drain 264 is provided to drain water from inside base sleeve 260.

A height adjustment assembly 266 is provided inside base sleeve 260 to allow the height of goose neck 12 to be adjusted with respect to ground 14. Height adjustment assembly 266 includes a rod 268 and a plurality of plates 270. Each plate 270 has a centrally disposed hole that allows the plate to slide over rod 268 down to the bottom of base sleeve 260 when goose neck 12 is removed from base sleeve 260. Rod 268 ensures that plates 270 remain aligned within base sleeve 260 and do not become jammed within base sleeve 260. Plates 270 are provided in a variety of different thicknesses so that the height of goose neck 12 and cross bar 18 may be precisely adjusted. For instance, when cross bar 18 must be raised with respect to the upper surface of ground 14, additional plates 270 are added at the bottom of base sleeve 260 until the desired height is achieved. Plates 270 may be provided in thicknesses such as 1/32 of an inch to provide for a precise adjustment of the height of cross bar 18. In operation, plates 270 may be loaded onto rod 268 and lowered into base sleeve 260. An end plate 272 is connected to rod 268 so that plates 270 may be easily removed from base sleeve 260.

Collar 262 holds goose neck 12 in position and allows the rotational position of goose neck 12 to be adjusted with respect to ground 14. Collar 262 includes holding bolts 274 that extend through collar 262 to engage goose neck 12. Lock nuts 276 are provided on each bolt 274 to lock bolt 274 in place. Bolts 274 not only clamp goose neck 12 in place but also may be used to adjust the vertical position of goose neck 12 by rotating the vertical portion of goose neck 12 about the x and z axes.

The adjustment tab 280 slides through a slot 282 formed in collar 262. A pair of rotational adjustment bolts 284 engage tab 280 and allow the user to selectively rotate goose neck 12 about the y axis. Lock nuts 286 are provided to lock the position of bolts 284.

Figure 29:
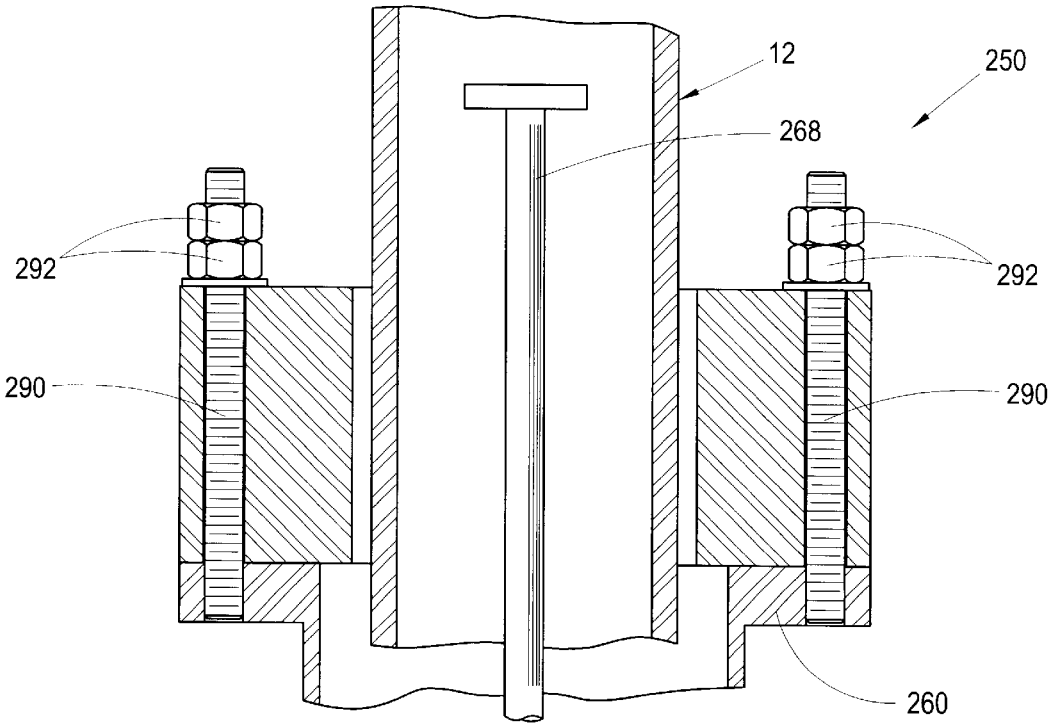
FIG. 29 is a sectional view taken along line 29—29 of FIG. 27.
Figure 30:
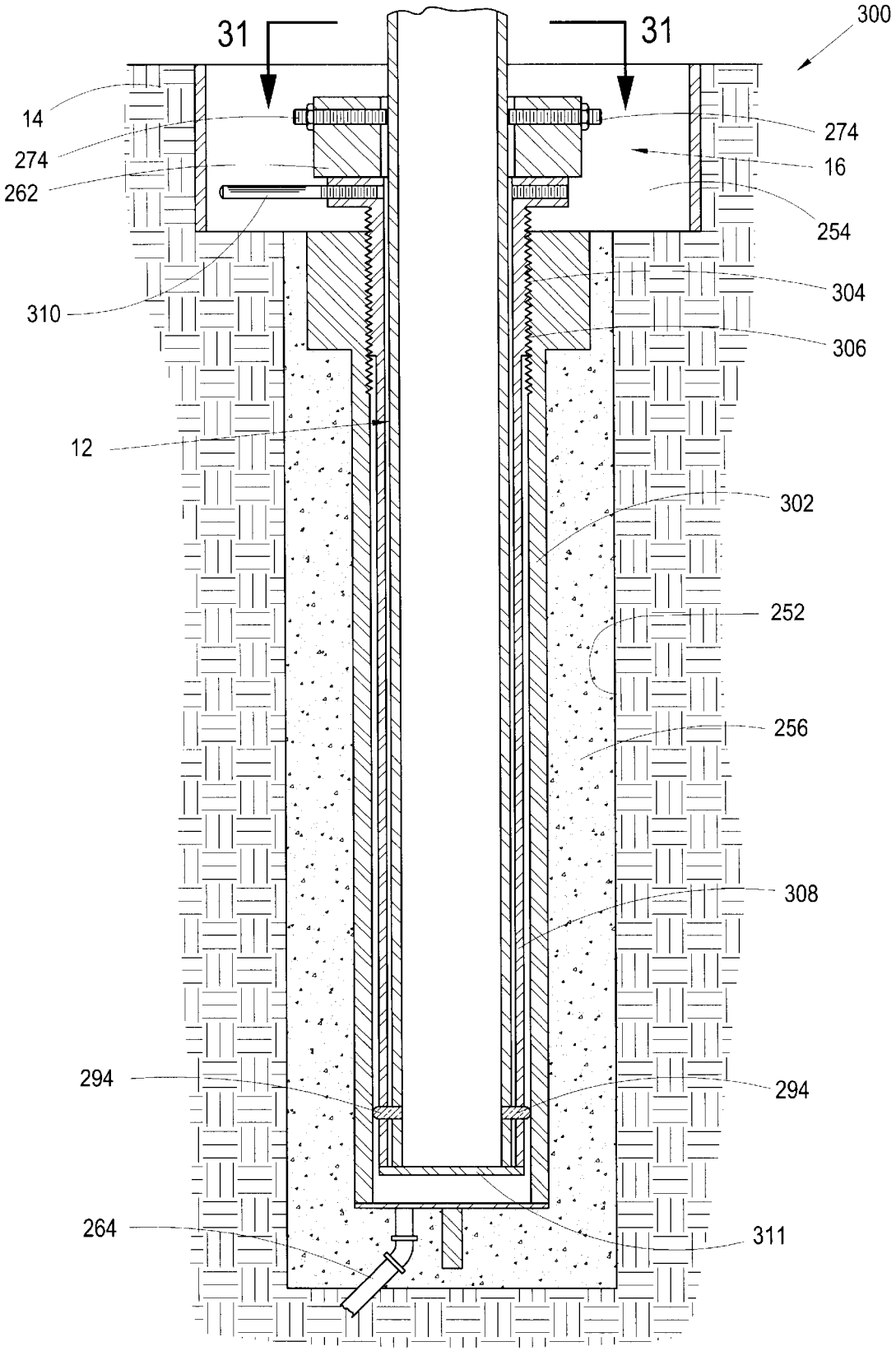
FIG. 30 is a sectional view of a second embodiment of the adjustable ground sleeve of the present invention.
Figure 31:
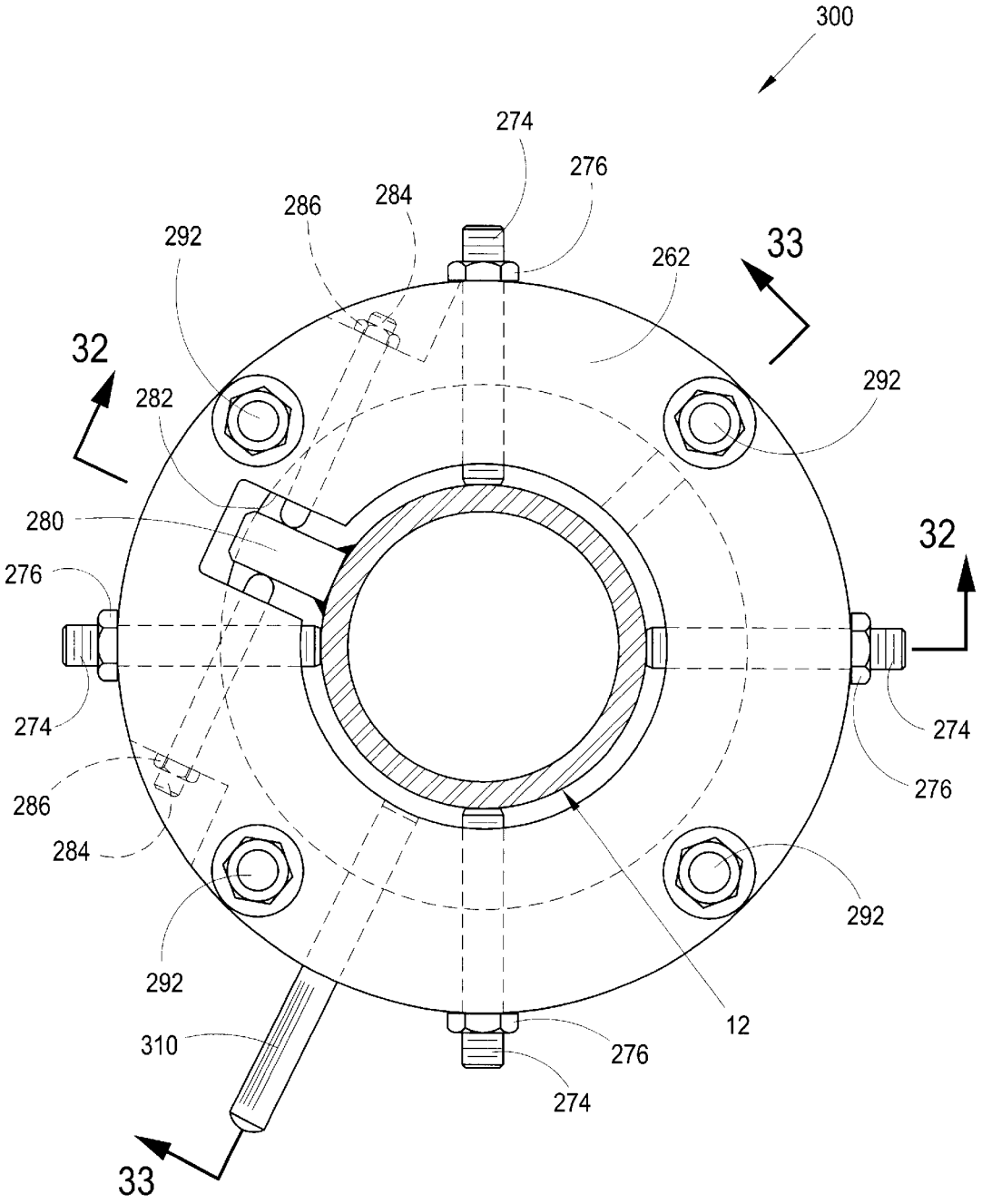
FIG. 31 is a view taken substantially along line 31—31 of FIG. 30.
Figure 32:
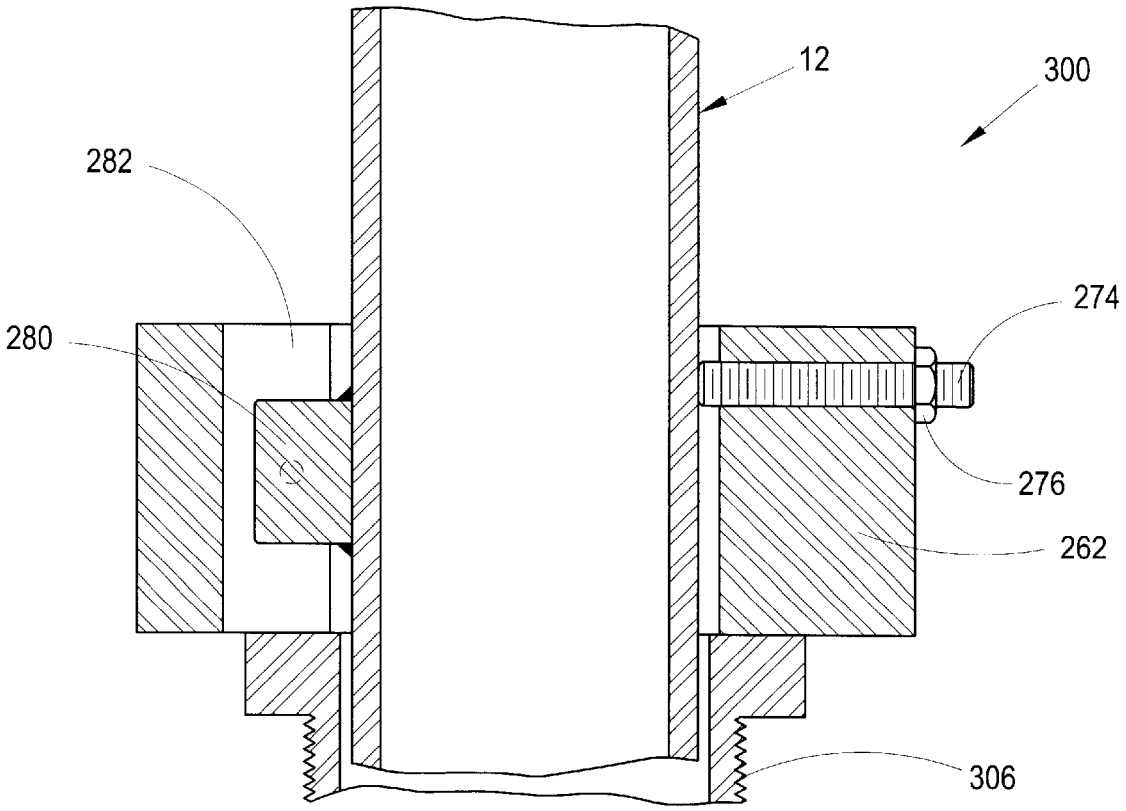
FIG. 32 is a sectional view taken along line 32—32 of FIG. 31.
Figure 33:
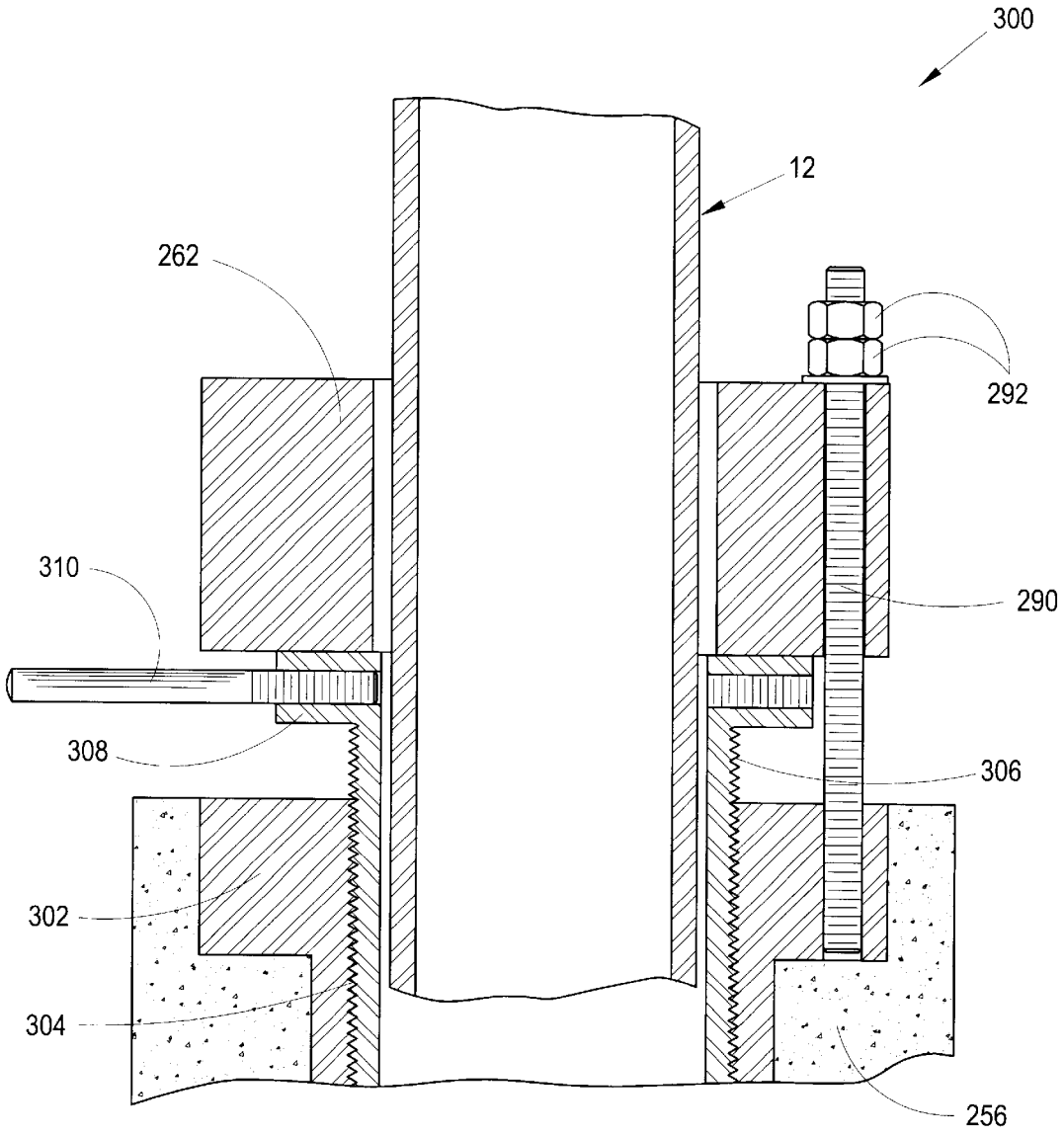
FIG. 33 is a sectional view taken along line 33—33 of FIG. 31.

Collar 262 is held in place by a plurality of mounting bolts 290 that threadedly engage the upper portion of base sleeve 260 as shown in FIG. 29. Bolts 290 are disposed outside the outer diameter of adjustment tab 280 so as to not interfere with the rotational adjustment capabilities of ground sleeve 250. In the preferred embodiment, four bolts to 290 are provided. Each bolt 290 includes a pair of nuts 292 to lock bolts 290 in place.

Another feature of ground sleeve 250 is that base sleeve 260 is configured to engage a plurality of stabilizers 294 extending from the lower portion of goose neck 12. The stabilizers 294 cause goose neck 12 to pivot about the lower portion of goose neck 12 and maintain a substantially centered position within base sleeve 260.

The second embodiment of the ground sleeve is indicated generally by the numeral 300 in FIGS. 30–33. Ground sleeve 300 includes many of the same elements as ground sleeve 250 and these elements are labeled with the same numbers used in FIGS. 26–29. Ground sleeve 300 includes a base sleeve 302 that functions substantially similar to base sleeve 260 except that its upper portion has inwardly facing threads 304 that threadedly engage outwardly facing threads 306 on a cradle 308. Cradle 308 includes an end wall 311 that supports the end of goose neck 12. A handle 310 extends radially outwardly from cradle 308 to allow the user to rotate cradle 308 with respect to base sleeve 302. The rotation of cradle 308 and threads 304 and 306 cause goose neck 12 to raise and lower with respect to ground 14. Ground sleeve 300 thus allows goose neck 12 to be adjusted about all axes x, y, and z as well as being rotated about the y axis.

Accordingly, the improved goal posts with adjustable components apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the goal posts with adjustable components is constructed and used, the characteristics of the construction, and the advantageous new and useful results obtained; the new and useful structures, devices, elements, arrangements, parts, and combinations are set forth in the appended claims.

What is claimed is:

1. A football goal post, comprising:

a base;

a cross bar having first and second opposite ends;

the cross bar including a first member connected to the base and a pair of second members movable relative to the first member;

a first upright carried by the cross bar and extending up from the first end of the cross bar;

a second upright carried by the cross bar and extending up from the second end of the cross bar; and adjustment means for allowing one person to simultaneously adjust the relative position of the first and second members of the cross bar to adjust the spacing of the uprights.

2. The goal post of claim 1, wherein the adjustment means includes a screw having a pair of oppositely-threaded screw portions.

3. The goal post of claim 2, wherein the adjustment means includes a threaded block connected to each of the second members of the cross bar; each of the threaded blocks threadedly engaging one of the screw portions of the screw.

4. The goal post of claim 1, wherein the adjustment means includes a pair of linear actuators.

5. The goal post of claim 1, wherein the adjustment means includes a pair of power jacks.

6. The goal post of claim 1, wherein the adjustment means includes a rack and pinion system.

7. The goal post of claim 1, further comprising a key extending between the first and second members of the cross bar to prevent the first and second members of the cross bar from rotating with respect to each other.

8. The goal post of claim 1, wherein the first and second members of the cross bar include portions having noncircular cross sections that prevent the first and second members of the cross bar from rotating with respect to each other.

9. A football goal post, comprising:

a base;

a cross bar having first and second opposite ends;

the cross bar including a first member connected to the base and a pair of second members movable relative to the first member; one of the first and second members having a diameter larger than the diameter of the other member;

a first upright carried by the cross bar and extending up from the first end of the cross bar;

a second upright carried by the cross bar and extending up from the second end of the cross bar;

adjustment means for simultaneously adjusting the relative position of the first and second members of the cross bar to adjust the spacing of the uprights between retracted and extended positions;

the cross bar having gaps when the second members are in the extended position;

a pair of sleeves selectively mountable to the cross bar in the gaps; each sleeve having a diameter substantially equal to the diameter of the larger member of the cross bar such that the diameter of the cross bar is maintained when the uprights are in the extended position; each of the sleeves being fabricated from a rigid material that holds its diameter when the sleeves are positioned in the gaps.

10. A football goal post, comprising:

a base;

a cross bar having first and second opposite ends;

the cross bar including a first member connected to the base and a pair of second members movable relative to the first member between retracted an extended positions; the first and second members defining a pair of gaps when the second members are in the extended position;

a first upright carried by the cross bar and extending up from the first end of the cross bar;

a second upright carried by the cross bar and extending up from the second end of the cross bar; and adjustment means for simultaneously adjusting the relative position of the first and second members of the cross bar to adjust the spacing of the uprights;

a pair of thin-walled rigid sleeves connected to one of the first and second members of the cross bar to maintain a substantially constant diameter of the cross bar when the spacing of the uprights is adjusted in any position; the sleeves covering the gaps when the second members are in the extended position.

11. The goal post of claim 10, wherein the thin sleeves extend along substantially the entire length of the cross bar when the cross bar is in a retracted position.

12. The goal post of claim 1, wherein the adjustment means includes activation means remotely located from the goal post.

13. The goal post of claim 1, wherein the adjustment means includes a powered adjustment mechanism.

14. A football goal post, comprising:

a base;

a cross bar having first and second opposite ends;

the cross bar including a first member connected to the base and a pair of second members movable relative to the first member between retracted and extended positions, the second members defining gaps between the second members and the first members when the second members are in the extended position;

the first member having an outer diameter;

a first upright carried by the cross bar and extending up from the first end of the cross bar;

a second upright carried by the cross bar and extending up from the second end of the cross bar;

adjustment means for allowing the relative position of the first and second members of the cross bar to be adjusted to adjust the spacing of the uprights; and sleeve means for maintaining a substantially constant diameter along the cross bar; the sleeve means being positionable over each of the gaps created when the second members are in the extended position; the sleeve means having an outer diameter substantially equal to the outer diameter of the first member.

15. The goal post of claim 14, wherein the sleeve means includes at least one sleeve mounted to the cross bar.

16. The goal post of claim 14, wherein the sleeve means includes at least one sleeve selectively connected to the cross bar.

17. A football goal post, comprising:

a base;

a cross bar having first and second opposite ends;

the cross bar including a first member connected to the base and a pair of second members movable relative to the first member;

a first upright carried by the cross bar and extending up from the first end of the cross bar;

a second upright carried by the cross bar and extending up from the second end of the cross bar;

a first adjustment mechanism disposed between the first member and one of the second members;

a second adjustment mechanism disposed between the first member and the other of the second members;

each of the adjustment mechanisms capable of adjusting the relative position of a second member with respect to the first member;

a first input device operatively connected to the first adjustment mechanism and a second input device operatively connected to the second adjustment mechanism; the first input device being disposed at the first end of the cross bar; and the second input device being disposed at the second end of the cross bar.

18. The goal post of claim 17, wherein each of the adjustment mechanisms includes a threaded shaft and a threaded block; the threaded shaft engaging the block such that rotation of the threaded shaft adjusts the position of the second member with respect to the first member.

19. The goal post of claim 18, wherein the threaded shaft is connected to the second member and the threaded block is connected to the first member; the threaded shaft moving longitudinally with the second member as the second member is adjusted with respect to the first member.

20. A football goal post, comprising:

a base;

a cross bar having first and second opposite ends;

the cross bar including a first member connected to the base and a pair of second members movable relative to the first member;

a first upright carried by the cross bar and extending up from the first end of the cross bar;

a second upright carried by the cross bar and extending up from the second end of the cross bar;

a first adjustment mechanism disposed between the first member and one of the second members;

a second adjustment mechanism disposed between the first member and the other of the second members;

each of the adjustment mechanisms capable of adjusting the relative position of a second member with respect to the first member;

each of the adjustment mechanisms including a threaded shaft and a threaded block; the threaded shaft engaging the block such that rotation of the threaded shaft adjusts the position of the second member with respect to the first member;

the threaded shaft being connected to the second member and the threaded block is connected to the first member; the threaded shaft moving longitudinally with the second member as the second member is adjusted with respect to the first member; and a pair of input devices; each of the threaded shafts connected to one of the input devices; the input devices being disposed at the first and second ends of the cross bar.

21. A football goal post mounted in the ground; the goal post comprising:

an adjustable ground sleeve adapted to be mounted to the ground;

a base being mounted in the adjustable ground sleeve;

a cross bar having first and second opposite ends; the cross bar being connected to the base;

a first upright carried by the cross bar and extending up from the first end of the cross bar;

a second upright carried by the cross bar and extending up from the second end of the cross bar; and means for adjusting the position of the base with respect to the ground; the adjustable ground sleeve configured to allow the base to be adjusted about three perpendicular axes as well as being raised or lowered along one of the three perpendicular axes.

22. The goal post of claim 21, wherein the adjustable ground sleeve includes a height adjustment assembly that includes a rod and at least one plate; the plate being selectively positioned under the base.

23. The goal post of claim 21, wherein the adjustable ground sleeve includes a collar; a tab connected to the base; and a pair of opposed bolts carried by the collar and engaging the tab.

24. The goal post of claim 21, wherein the adjustable ground sleeve includes a base sleeve having a first threaded portion, a cradle having a second threaded portion; the base carried by the cradle; and wherein the first and second threaded portions threadedly engage each other to allow relative rotation to adjust the height of the base.

25. The goal post of claim 21, wherein the adjustable ground sleeve includes a base sleeve; the base being carried in the base sleeve; and a stabilizer connected to the base, the stabilizer engaging the base sleeve.

26. The goal post of claim 25, wherein the adjustable goal post further includes a collar connected to the base sleeve; the collar including a plurality of bolts that adjustably engage the base.

* * * * *